US006492770B2

(12) United States Patent
Amemiya et al.

(10) Patent No.: US 6,492,770 B2
(45) Date of Patent: Dec. 10, 2002

(54) PLASMA DISPLAY PANEL

(75) Inventors: Kimio Amemiya, Yamanashi-ken (JP); Yasuhiro Torisaki, Yamanashi-ken (JP)

(73) Assignees: Pioneer Corporation, Tokyo (JP); Shizuoka Pioneer Corporation, Shizuoka-ken (JP)

( * ) Notice: Subject to any disclaimer, the term of this patent is extended or adjusted under 35 U.S.C. 154(b) by 119 days.

(21) Appl. No.: 09/774,601

(22) Filed: Feb. 1, 2001

(65) Prior Publication Data

US 2001/0011871 A1 Aug. 9, 2001

(30) Foreign Application Priority Data

Feb. 7, 2000 (JP) ..... 2000-029392
Nov. 9, 2000 (JP) ..... 2000-341911

(51) Int. Cl.[7] ..... H01J 17/49

(52) U.S. Cl. ..... 313/586; 313/582; 313/593

(58) Field of Search ..... 313/582, 586, 313/593

*Primary Examiner*—Vip Patel
(74) *Attorney, Agent, or Firm*—Arent Fox Kintner Plotkin & Kahn

(57) ABSTRACT

A plasma display panel including a partition wall (35) arranged between a front substrate (10) and a back substrate (13), and having vertical walls (35*a*) extending in the column direction and transverse walls (35*b*) extending in the row direction to define a discharge space (S) into each discharge cell (C) in the row direction and the column direction. A clearance (SL) extending in parallel to the row direction divides the transverse wall (35*b*) situated between the adjacent discharge cells (c) respectively in the column direction to each other. A groove (11A*a*) formed in the additional dielectric layer (11A) makes communication between the inside of the clearance (SL) and the inside of the adjacent discharge cells (C) in the column direction.

19 Claims, 26 Drawing Sheets

V 3 — V 3

V 4 — V 4

W3 — W3

W4 — W4

W5 – W5

V5—V5

W6—W6

V6—V6

W7—W7

W8—W8

W9—W9

V—V

W—W

V 1 — V 1

V 2 — V 2

W1 – W1

W2 – W2

PLASMA DISPLAY PANEL

BACKGROUND OF THE INVENTION

1. Field of the Invention

The invention relates to a panel structure of a surface discharge scheme AC type plasma display panel.

2. Description of the Related Art

Recent years, a plasma display panel of a surface discharge scheme AC type as an oversize and slim display for color screen has been received attention, which is becoming widely available.

FIG. 27 is a schematically front view illustrating a cell structure of a conventional surface discharge scheme AC type plasma display panel. FIG. 28 is a sectional view taken along the V—V line of FIG. 27. FIG. 29 is a sectional view taken along the W—W line of FIG. 27.

In FIGS. 27 to 29, on the backside of a front glass substrate 1 to serve as a display screen of the plasma display panel (referred as "PDP" hereinafter), there is sequentially provided with a plurality of row electrode pairs (X', Y'); a dielectric layer 2 overlaying the row electrode pairs (X', Y'); and a protective layer 3 made of MgO which overlays a backside of the dielectric layer 2.

The row electrodes X' and Y' are respectively comprised of wider transparent electrodes Xa' and Ya' each of which is formed of a transparent conductive film made of ITO (Indium Tin Oxide) or the like, and narrower bus electrodes Xb' and Yb' each of which is formed of a metal film, complementary to conductivity of the transparent electrode.

The row electrodes X' and Y' are arranged opposing each other with a discharge gap g' in between, and alternate in the column direction such that each row electrode pair (X', Y') forms a display line (row) L on a matrix display screen.

A back glass substrate 4 faces the front glass substrate 1 with a discharge space S', filled with a discharge gas, in between. The back glass substrate 4 is provided with a plurality of column electrodes D' arranged to extend in a direction perpendicular to the row electrode pairs X' and Y'; band-shaped partition walls 5 each extending between the adjacent column electrodes D' in parallel; and a phosphor layer 6 consisting of a red phosphor layer 6(R), green phosphor layer 6(G) and blue phosphor layer 6(B) which respectively overlay side faces of the partition walls 5 and the column electrodes D'.

In each display line L, the partition walls 5 divides discharge space S' at each intersection of the column electrode D' and the row electrode pair (X', Y') to defines discharge cells C' serving as unit light emitting area.

In the above surface discharge scheme AC type PDP, an image is displayed as follows:

First, through address operation, discharge (opposite discharge) is caused selectively between the row electrode pairs (X', Y') and the column electrodes D' in the respective discharge cells C', to scatter lighted cells (the discharge cell in which wall charge is formed on the dielectric layer 2) and nonlighted cells (the discharge cell in which wall charge is not formed on the dielectric layer 2), over the panel in accordance with the image to be displayed.

After the address operation, in all the display lines L, the discharge sustain pulse is applied alternately to the row electrode pairs (X', Y') in unison, and thus discharge (surface discharge) is produced in the lighted cells on every application of the discharge sustain pulse.

In this manner, the surface discharge in each lighted cell generates ultraviolet radiation, and thus the red phosphor layer 6(R) and/or the green phosphor layer 6(G) and/or the blue phosphor layer 6(B) each formed in the discharge cell C' are excited to emit light, resulting in forming the display image.

In the above structure of the conventional PDP, the disadvantage of inferior brightness on the screen has arisen because as each discharge cell C' is decreased in size for increasing definition of the screen, the surface area of the phosphor layer 6 decreases.

Further, another disadvantage that false discharge tends to occur arises because if a pitch of the row electrode pair (X', Y') is decreased for responding to a demand for high definition of the screen, interference occurs between discharges of the discharge cells C' adjoining in the column direction (in the vertical direction of FIG. 27).

Hence, the applicant of the present invention suggests a new surface discharge scheme AC type PDP as illustrated in FIG. 30 to FIG. 34.

In FIG. 30 to FIG. 34, the PDP is configured such that, on a backside of a front glass substrate 10 serving as the display surface, a plurality of row electrode pairs (X, Y) are arranged in parallel to extend in the row direction (the traverse direction on FIG. 30) of the front glass substrate 10.

The row electrode X is composed of transparent electrodes Xa formed in a T-like shape of a transparent conductive film made of ITO or the like, and a bus electrode Xb which is formed of a metal film extending in the row direction of the front glass substrate 10 to connect to a proximal end of the narrowed portion of the transparent electrode Xa.

Likewise, row electrode Y is composed of a transparent electrode Ya which is formed in a T-like shape of a transparent conductive film made of ITO or the like, and a bus electrode Yb which is formed of a metal film extending in the row direction of the front glass substrate 10 to connect to a proximal end of the narrowed portion of the transparent electrode Ya.

The row electrodes X and Y are alternated in the column direction (in the vertical direction on FIG. 30) of the front glass substrate 10. The transparent electrodes Xa and Ya arranged along the respective bus electrodes Xb and Yb, extend mutually toward a mate of the paired row electrodes such that the top sides (or the distal ends) of the wide portions of the transparent electrodes Xa and Ya mutually face on the opposite sides of a discharge gap g having a predetermined width.

Each of the bus electrodes Xb and Yb is formed in a double layer structure with a black conductive layer Xb' or Yb' on the display surface side and a main conductive layer Xb" or Yb" on the back surface side.

A dielectric layer 11 is formed further on the backside of the front glass substrate 10 to overlay the row electrode pairs (X, Y). Furthermore, on the backside of the dielectric layer 11, an additional dielectric layer 11A is formed in each position which opposes the adjacent bus electrodes Xb and Yb of the respective row electrode pairs (X, Y) adjacent to each other, plus which opposes an area between the adjacent bus electrodes Xb and Yb, to protrude from the backside of the dielectric layer 11 and to extend in parallel to the bus electrodes Xb, Yb.

On the backsides of the dielectric layer 11 and the additional dielectric layers 11A, a protective layer 12 made of MgO is formed.

Next, a back glass substrate 13 is arranged in parallel to the front glass substrate 10. On the front surface of the back glass substrate 13 facing toward the display surface, column electrodes D are disposed at regularly established intervals from one another to extend at positions opposing the transparent electrodes Xa and Ya of the respective pairs of the row electrodes (X, Y), in a direction orthogonal to the row electrode pair (X, Y) (the column direction).

A white dielectric layer 14 is further formed on the face of the back glass substrate 13 on the display surface side to overlay the column electrodes D, and in turn formed thereon with a partition wall 15.

The partition wall 15 is formed in a pattern, in which parallel lines cross at right angles, by a vertical wall 15*a* extending in the column direction between the adjacent column electrodes D arranged in parallel to each other, and a transverse wall 15*b* extending in the row direction in a position opposing each additional dielectric layer 11A.

The partition wall 15 formed in such pattern defines the discharge space S between the front glass substrate 10 and the back glass substrate 13 into a chessboard-square-like pattern to form a quadrangular discharge cell C for each square opposing the paired transparent electrodes Xa and Ya of each row electrode pair (X, Y)

The partition wall 15 is formed in a two-layer structure with a black layer (a light absorption layer) 15' on the display surface side and a white layer (a light reflection layer) 15" on the back surface side, which is configured such that the side wall facing the discharge space S is almost white (i.e. a light reflection layer).

The surface of the vertical wall 15*a* of the partition wall 15 on the display surface side is not in contact with the protective layer 12 (see FIGS. 32, 33), and a clearance r is formed between the vertical wall 15*a* and the protective layer 12. The surface of the transverse wall 15*b* on the display surface side is in contact with a portion of the protective layer 12 overlaying the additional dielectric layer 11A (see FIGS. 31, 34), to shield the adjoining discharge cells in the column direction from each other.

On the five faces of a surface of the dielectric layer 14 and the side faces of the vertical walls 15*a* and the transverse walls 15*b* of the partition wall 15 facing each discharge space S, a phosphor layer 16 is formed to overlay all of them. The phosphor layers 16 are set in order of red (R), green (G) and blue (B) for the sequence of discharge space S in the row direction.

The inside of the discharge space S is filled with a discharge gas.

In the above PDP, a row electrode pair (X, Y) make up a display line (row) L on a matrix display screen.

As in the PDP illustrated in FIGS. 27 to 29, operation of displaying an image on the PDP is carried out.

Specifically, first, through address operation, the discharge is produced selectively between the row electrode pairs (X, Y) and the column electrodes D, to scatter lighted cells and nonlighted cells in all the display lines L over the panel in accordance with the image to be displayed.

After that, in all the display lines L, the discharge sustain pulses are applied alternately to the row electrode pairs (X', Y') in unison. This causes surface discharge in each lighted cell.

In this manner, the surface discharge in each lighted cell generates ultraviolet radiation, and thus the red, green and blue phosphor layers 16 each formed in the discharge cell C are individually excited to emit light, resulting in forming the display screen.

The above PDP has a feature in that since the transparent electrodes Xa, Ya of the row electrode X, Y extend from the respective bus electrode Xb, Yb toward a mate of the paired row electrodes to independently shape into an island-like form in each discharge cell C, even if each discharge cell is reduced in size to increase definition of a screen, there may not be occurrence of interference between the discharges of the adjacent discharge cells in the row direction.

Further, the above PDP features as follows: the additional dielectric layer 11A is formed on the dielectric layer 11 and the protective layer 12 overlaying the additional dielectric layers 11A is in contact with the surface of the transverse wall 15*b* of the partition wall 15 on the display surface side, to shield the adjacent discharge cells C in the column direction from each other. This prevents occurrence of interference between discharges of the adjacent discharge cells C in the column direction.

Additionally, the surface of the vertical wall 15*a* of the partition wall 15 on the display surface side faces the portion of the dielectric layer 11 in which the additional dielectric layer 11A is not formed, to form the clearance r between the above surface of the vertical wall 15*a* on the display surface side and the protective layer 12.

Therefore, the adjacent discharge cells C in the row direction slightly communicate via the clearance r with each other, to produce the priming effect of causing the discharge such as in a chain reaction, or causing the discharge to transfer to the adjacent discharge cell. This results in stabilization of the discharge operation.

However, in the structure of the above PDP, since the protective layer 12 overlaying the additional dielectric layer 11A and transverse wall 15*b* are in contact with each other to completely shield the adjacent discharge cells C from each other in the column direction, the priming effect which is secured between the adjacent discharge cells C in the row direction as described above, cannot be secured in the column direction at all. This increases a discharge delay time in selecting the discharge in the address operation when the image is formed.

In order to stabilize the selection discharge, a drive pulse applied in the address operation is needed to increase in width, which results in producing a disadvantage of extending a time required for the address operation.

SUMMARY OF THE INVENTION

The present invention has been made to solve the above disadvantages in the conventional surface discharge scheme AC type plasma display panel as described above.

It is therefore an object of the present invention to allow a plasma display panel in which a partition wall defines adjacent unit light emitting areas in a column direction to secure a sufficient priming effect.

To attain the above objects, a plasma display panel according to a first invention includes a plurality of row electrode pairs extending in a row direction and arranged in a column direction to form display lines and a dielectric layer overlaying the row electrode pairs on a backside of a front substrate, and a plurality of column electrodes extending in the column direction and arranged in the row direction to constitute unit light emitting areas at respective positions corresponding to intersections of the column electrodes and the row electrode pairs in the discharge space on a face of a back substrate facing the front substrate with a discharge space in between. Such plasma display panel features in that: a partition wall is arranged between the front substrate and the back substrate, and has vertical walls extending in the column direction and the transverse walls extending in the row direction to define the discharge space into each of the unit light emitting areas in the row direction and the column direction; the transverse wall situated between the adjacent unit light emitting areas respectively in the column direction to each other, is divided by a clearance extending in parallel to the row direction; and the inside of the clearance and the inside of the discharge spaces in the adjacent unit light emitting areas in the column direction are communicated with each other by a communicating section.

The plasma display panel according to the first invention is designed such that the partition wall having the vertical walls extending in the column direction and the transverse walls extending in the row direction defines the discharge space, formed between the front substrate and the back substrate, into the unit light emitting areas.

The transverse wall situated between the adjacent unit light emitting areas respectively in the column direction is divided by the clearance extending in parallel with the row direction. The clearance formed between the divided transverse walls communicates with the insides of the discharge spaces in the adjacent light emitting areas in the column direction through the communicating section.

In consequence, according to the first invention, even when the transverse wall of the partition wall shield the adjacent unit light emitting areas from each other in the column direction, priming particles (pilot flame) which are caused by discharge in the clearance between the divided transverse walls accompanied with the discharge caused in the unit light emitting area, diffuse through the communicating section into the unit light emitting areas adjacent to the clearance in the column direction to induce discharge. For this reason, the priming effect between the adjacent unit light emitting areas in the column direction is secured.

To attain the aforementioned object, the plasma display panel according to a second invention features, in addition to the configuration of the first invention, in that an additional portion is formed on each part of the dielectric layer opposing the transverse wall of the partition wall and the clearance to protrude from the dielectric layer toward the transverse wall to shield the adjacent unit light emitting areas in the column direction in cooperation with the transverse wall, and the communicating section is formed in the additional portion.

According to the plasma display panel of the second invention, the transverse wall and the additional portion formed on the dielectric layer to protrude therefrom toward the transverse wall, shield the adjacent unit light emitting areas in the column direction from each other. This prevents occurrence of false discharge between the adjacent unit light emitting areas in the column direction.

Further, through the communicating section formed in the additional portion for making communication between the clearance between the divided transverse walls and the adjacent unit light emitting areas in the column direction, priming particles (pilot flame) which are caused by the discharge in the clearance between the divided transverse walls, diffuse into the unit light emitting areas adjacent to the clearance in the column direction to induce discharge. For this reason, the priming effect between the adjacent unit light emitting areas in the column direction is secured.

To attain the aforementioned objects, the plasma display panel according to a third invention features, in addition to the configuration of the first invention, in that the communicating section is formed in the transverse wall of the partition wall.

According to the plasma display panel of the third invention, even when the transverse wall of the partition wall shield the adjacent unit light emitting areas from each other in the column direction, through the communicating section formed in the transverse wall for making communication between the clearance between the divided transverse walls and the adjacent unit light emitting areas in the column direction, priming particles (pilot flame) which are caused by discharge in the clearance between the divided transverse walls, diffuse into the unit light emitting areas adjacent to the clearance in the column direction to induce discharge. For this reason, the priming effect between the adjacent unit light emitting areas in the column direction is secured.

To attain the aforementioned objects, the plasma display panel according to a fourth invention features, in addition to the configuration of the first invention, in that at least a portion of the transverse wall of the partition wall is lower in height than that of the vertical wall to form a clearance between the transverse wall and the dielectric layer to constitute the communicating section.

According to the plasma display panel of the fourth invention, even when the adjacent unit light emitting areas in the column direction are shield from each other, the communicating section formed in the portion where a height of the transverse wall of the partition wall is lower than that of the vertical wall, makes communication between the clearance between the divided transverse walls and the adjacent unit light emitting areas in the column direction.

Therefore, priming particles (pilot flame) which are caused by discharge in the clearance between the divided transverse walls, diffuse into the unit light emitting areas adjacent to the clearance in the column direction to induce discharge. For this reason, the priming effect between the adjacent unit light emitting areas in the column direction is secured.

To attain the aforementioned objects, the plasma display panel according to a fifth invention features, in addition to the configuration of the first invention, in that a dielectric rib having a lower height than that of the partition wall is formed in part of the clearance opposing the column electrode on the back substrate.

According to the plasma display panel of the fifth invention, due to the dielectric rib formed in the clearance between the divided transverse walls of the partition wall, a discharge distance between the column electrode on the back substrate side and the row electrode on the front substrate side is decreased. This facilitates occurrence of the discharge in the clearance, resulting in further enhancing the priming effect in the column direction.

To attain the aforementioned objects, the plasma display panel according to a sixth invention features, in addition to the configuration of the fifth invention, in that the column electrode is formed on the dielectric rib.

According to the plasma display panel of the sixth invention, due to the dielectric rib formed in the clearance between the divided transverse walls of the partition wall, a distance between the column electrode on the back substrate side and the row electrode on the front substrate side is decreased. This decreases the discharge distance thereby to further facilitate occurrence of the discharge in the clearance, resulting in further enhancing the priming effect in the column direction.

To attain the aforementioned objects, the plasma display panel according to a seventh invention features, in addition to the configuration of the fifth invention, in that the dielectric rib is formed in an island-like shape for each column electrode.

According to the plasma display panel of the seventh invention, due to the island-shaped dielectric rib formed in the clearance between the divided transverse walls of the partition wall, a discharge distance between the column electrode on the back substrate side and the row electrode on the front substrate side is decreased. This facilitates occurrence of the discharge in the clearance, resulting in further enhancing the priming effect in the column direction.

To attain the aforementioned objects, the plasma display panel according to an eighth invention features, in addition to the configuration of the fifth invention, in that the dielectric rib is formed in a band-like shape extending in the row direction.

According to the plasma display panel of the eighth invention, due to the band-shaped dielectric rib formed in the clearance between the divided transverse walls of the partition wall, a discharge distance between the column electrode on the back substrate side and the row electrode on the front substrate side is decreased. This facilitates occurrence of the discharge in the clearance, resulting in further enhancing the priming effect in the column direction.

To attain the aforementioned objects, the plasma display panel according to a ninth invention features, in addition to the configuration of the first invention, in that a layer is made of materials of a high coefficient of secondary electron emission, and formed in a part in the clearance opposing the column electrode on the back substrate.

According to the plasma display panel of the ninth invention, since the layer made of materials of a high coefficient of secondary electron emission is formed in the clearance between the divided transverse wall of the partition wall, occurrence of the discharge between the column electrode and the row electrode in the clearance is facilitated. This further enhance the priming effect in the column direction.

The layer made of materials of a high coefficient of secondary electron emission may be formed in an island-like shape or a band-like shape extending in the row direction.

To attain the aforementioned objects, the plasma display panel according to a tenth invention features, in addition to the configuration of the first invention, in that a light absorption layer is provided on a part of the front substrate opposing the clearance.

According to the plasma display panel of the tenth invention, the light absorption layer is formed on part of the front substrate opposing the clearance between the divided transverse wall of the partition wall which is a non-display line. For this reason, even when the discharge for priming is caused between the column electrode and the row electrode in the clearance, the resulting light is prevented from leaking onto the image display screen from the front substrate, resulting in elimination of a possibility that the light adversely affect the contrast on the image.

To attain the aforementioned objects, the plasma display panel according to an eleventh invention features, in addition to the configuration of the first invention, in that a phosphor layer emitting ultraviolet radiation is provided on at least a part of parts of the front substrate, the back substrate, and the partition wall opposing the clearance formed between the divided transverse wall.

According to the plasma display panel of the eleventh invention, since the phosphor layer emitting ultraviolet radiation is provided in the clearance between the divided transverse walls of the partition wall, through excitation by vacuum ultraviolet rays generated from the discharge gas filled in the discharge space upon discharge, ultraviolet radiation is emitted from the phosphor layer, and then generates secondary electrons in the unit light emitting area, resulting in the priming effect between the adjacent light emitting areas in the column direction.

To attain the aforementioned objects, the plasma display panel according to a twelfth invention features, in addition to the configuration of the first invention, in that a discharge section is formed in opposite parts of the respective back-to-back row electrodes of the adjacent row electrode pairs for causing discharge in a space in the clearance. The space in the clearance and the inside of the discharge spaces in the adjacent unit light emitting areas in column direction are communicated with each other through the communicating section.

The plasma display panel according to the twelfth invention uses the partition wall having the vertical walls extending in the column direction and the transverse walls extending in the row direction to define the discharge space, formed between the front substrate and the back substrate, into the unit light emitting areas. Further, the transverse wall situated between the unit light emitting areas arranged along the row adjacent to these unit light emitting areas is divided by the clearance extending in parallel to the row direction. The clearance between the divided transverse walls communicates with the inside of the discharge spaces in the adjacent unit light emitting areas in the column direction through the communicating section.

In the mutually opposite portions of the two back-to-back row electrodes of the adjacent row electrode pairs, for example, a part of one of the back-to-back row electrodes is protruded toward the other row electrode on the opposite side, to form a required discharge gap at a position facing the clearance formed between the divided transverse walls of the partition wall, resulting in formation of the discharge section.

Such plasma display panel is configured such that when a required discharge is performed in each row electrode pair for forming an image, the discharge section provided between the two back-to-back row electrodes of the adjacent row electrode pairs causes discharge in a space in the clearance situated at a position facing the discharge section.

The discharge (the priming discharge) in the above discharge section causes a pilot flame (priming particles) in the space in the clearance. The priming particles diffuse through the communicating section, making communication between the space in the clearance and the discharge spaces in the adjacent unit light emitting areas in the column direction, into the unit light emitting areas on the both sides.

As described above, according to the twelfth invention, even when the transverse wall of the partition wall shield the adjacent unit light emitting areas in the column direction from each other, the so-called priming discharge is performed in the clearance between the divided transverse walls defining the above unit light emitting areas, and the priming particles caused by this priming discharge diffuse through the communicating section into the unit light emitting areas adjacent to the clearance in the column direction, to induce a required discharge performed in the unit light emitting area by each row electrode pair for forming the image. For this reason, the so-called priming effect is exerted.

To attain the aforementioned objects, the plasma display panel according to a thirteenth invention features, in addition to the configuration of the twelfth invention, in that at least one side of opposite sides of the respective back-to-back row electrodes of the adjacent row electrode pairs protrudes toward the other side to form a discharge gap, having a required size and facing a space in the clearance, between the one side and the other side for formation of the discharge section.

According to the plasma display panel of the thirteenth invention, in the adjacent row electrode pairs, a part of one of the opposite row electrodes protrudes toward the other or the parts of both opposite row electrodes protrude toward each other.

Therefore, the part of the one row electrode and the other row electrode or the parts of both row electrodes are opposite to each other in a position facing the clearance between the divided transverse walls of the partition wall to form the discharge gap having a size required for causing the discharge. This constitutes the discharge section for causing the so-called priming discharge in the space in the clearance.

To attain the aforementioned objects, the plasma display panel according to a fourteenth invention features, in addition to the configuration of the thirteenth invention, in that the row electrode comprises a transparent electrode causing discharge in the unit light emitting area and a bus electrode connected to the transparent electrode, wherein at least one of the transparent electrodes of the respective back-to-back row electrodes of the adjacent row electrode pairs is protruded toward the other transparent electrode to form the discharge gap.

According to the plasma display panel of the fourteenth invention, the one transparent electrode making up the one row electrode has a portion which is opposite to the portion where the discharge is caused in the unit light emitting area. The portion protrudes toward the other transparent electrode making up the other row electrode of the adjacent row electrode pairs, to form the discharge gap, having a size required for causing the discharge, between the portion of the one transparent electrode and the other transparent electrode. This constitutes the discharge section for causing the so-called priming discharge in the space in the clearance.

The discharge section is configured by protruding the one transparent electrode toward the other transparent electrode or protruding both transparent electrodes toward each other.

To attain the aforementioned objects, the plasma display panel according to a fifteenth invention features, in addition to the configuration of the thirteenth invention, in that the row electrode comprises a transparent electrode causing discharge in each unit light emitting area and a bus electrode connected to the transparent electrode, wherein at least one of the bus electrodes of the respective back-to-back row electrodes of the adjacent row electrode pairs is protruded toward the other bus electrode to form the discharge gap.

According to the plasma display panel of the fifteenth invention, a part of the one bus electrode making up the row electrode protrudes toward the other bus electrode making up the opposite row electrode of the adjacent row electrode pairs. The discharge gap having a size required for causing the discharge is formed between the part of the one bus electrode and the other bus electrode. This constitutes the discharge section for causing the so-called priming discharge in the space in the clearance.

The discharge section is configured by protruding the one transparent electrode toward the other transparent electrode or protruding both transparent electrodes toward each other.

To attain the aforementioned objects, the plasma display panel according to a sixteenth invention features, in addition to the configuration of the thirteenth invention, in that the discharge gap is set to have a size smaller than that of a discharge gap between the row electrodes in each row electrode pair. This facilitates occurrence of the so-called priming discharge in the discharge section constituted between the adjacent row electrode pairs, resulting in securing the priming effect with reliability.

To attain the aforementioned objects, the plasma display panel according to a seventeenth invention features, in addition to the configuration of the twelfth invention, in that a first row electrode and a second row electrode constituting the row electrode pair are alternately interchanged in the column direction, the discharge section being formed between the opposite first row electrodes or the opposite second row electrode of the adjacent row electrode pairs.

According to the plasma display panel of the seventeenth invention, when one of the two row electrodes of the first row electrode and the second row electrode making up the row electrode pair, is associated with, for example, the discharge (the selection discharge) for selecting a unit light emitting area to emit light for formation of the image, the respective one row electrodes of the adjacent row electrode pairs associated with the selection discharge are opposite to each other, because the first electrode and the second electrode in each row electrode pair are alternately interchanged in position in the column direction.

By configuring the discharge section between the described-above respective one row electrodes which are opposite to each other and associated with the selection discharge, it is possible to cause the discharge by the discharge section only when the selection discharge is performed.

To attain the aforementioned objects, the plasma display panel according to an eighteenth invention features, in addition to the configuration of the twelfth invention, in that priming discharge sections are formed in the part of the row electrodes, oriented back to back and provided with the discharge section, in a non-display area of the plasma display panel for causing discharge in the space in the clearance.

According to the plasma display panel of the eighteenth invention, the priming discharge sections opposing each other with the discharge gap in between are further formed in the portions, extending into the non-display area of the plasma display panel, of the row electrodes of the adjacent row electrode pairs in which the discharge section for the priming discharge is formed, and also formed to face the clearance between the divided transverse wall of the partition wall. Therefore, the priming discharge is also caused in the above priming discharge sections when the required discharge for forming the image is performed in each row electrode pair.

In this way, the discharge section for the priming discharge is further provided in the non-display area of the plasma display panel which is facilitated to secure the discharge space for the priming discharge. Thus, the discharge section facilitating causing the discharge is provided with a different structure from that in the display area. This allows the priming discharge to be caused with reliability, which further enhance the priming effect.

To attain the aforementioned objects, the plasma display panel according to a nineteenth invention features, in addition to the configuration of the twelfth invention, in that an additional portion is formed on each part of the dielectric layer opposing the transverse wall of the partition wall and the clearance to protrude from the dielectric layer toward the transverse wall to shield the adjacent unit light emitting areas in the column direction in cooperation with the transverse wall, and a thickness of the part of the additional portion opposing the discharge section being smaller than that of other parts.

According to the plasma display panel of the nineteenth invention, the additional portion formed for shielding the adjacent unit light emitting areas from each other, is interposed between the discharge section formed between the adjacent row electrodes, and the clearance formed between the divided transverse walls in which the priming discharge is caused by the above discharge section. A recess is formed in the portion of the additional portion facing the discharge section. A thickness of the additional portion where the recess is formed is smaller than that of the remaining portion of the additional portion. This facilitates causing the discharge by the discharge section in the space in the clearance.

These and other objects and advantages of the present invention will become obvious to those skilled in the art upon review of the following description, the accompanying drawings and appended claims.

DETAILED DESCRIPTION OF THE PREFERRED EMBODIMENT

Most preferred embodiment according to the present invention will be described hereinafter in detail with reference to the accompanying drawings.

FIGS. 1 to 6 illustrate a first example of the embodiment of a plasma display panel (referred as "PDP" hereinafter) according to the present invention.

Figure 1:
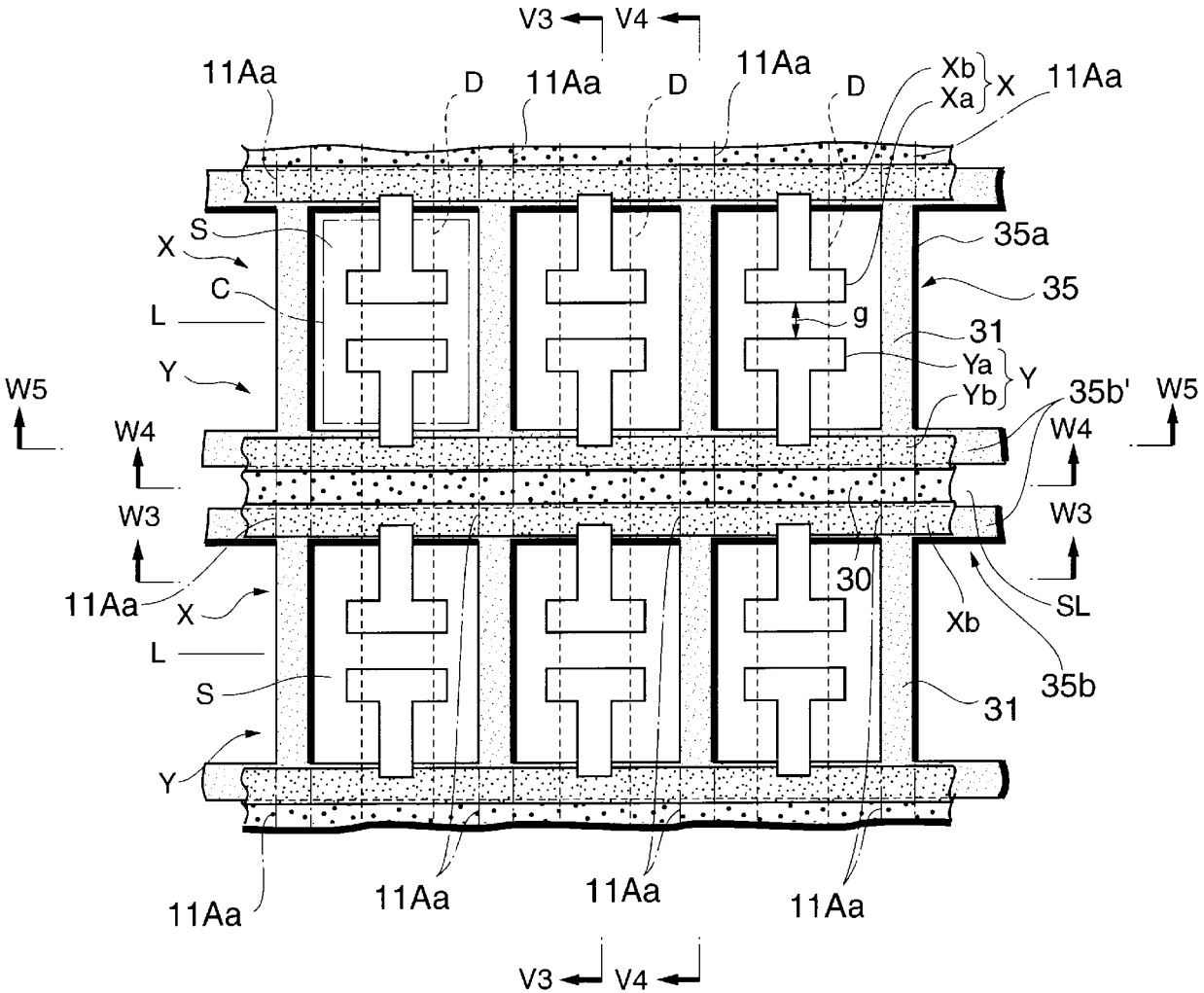
FIG. 1 is a front view schematically showing a first example according to the present invention.
Figure 2:
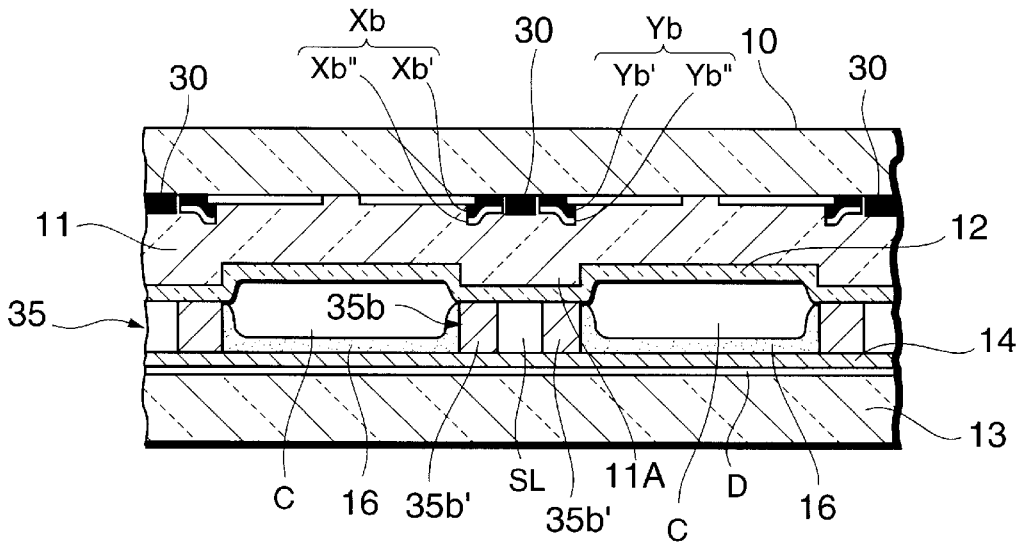
FIG. 2 is a sectional view taken along the V3—V3 line of FIG. 1.
Figure 3:
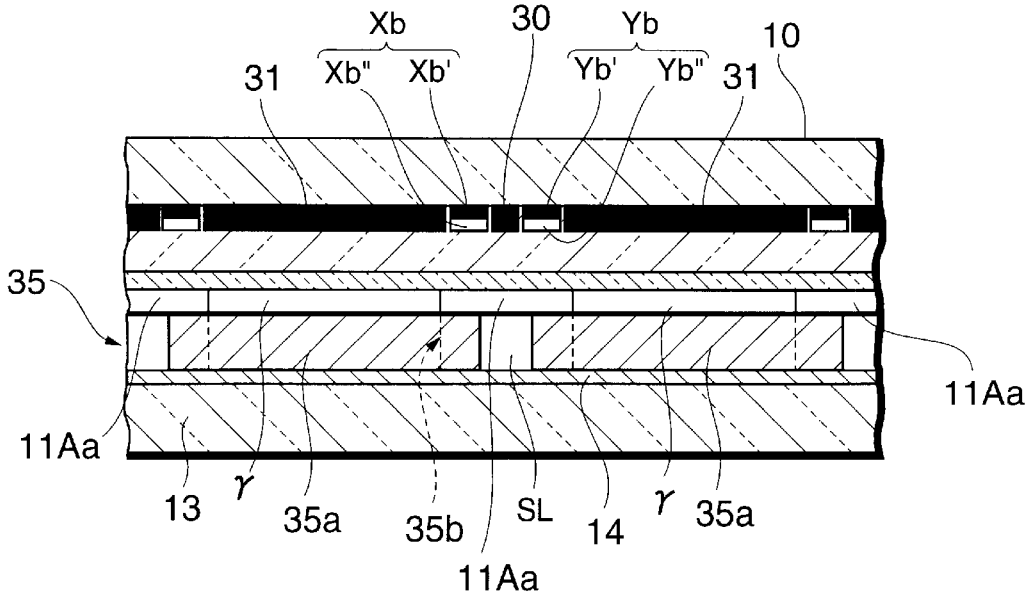
FIG. 3 is a sectional view taken along the V4—V4 line of FIG. 1.
Figure 4:
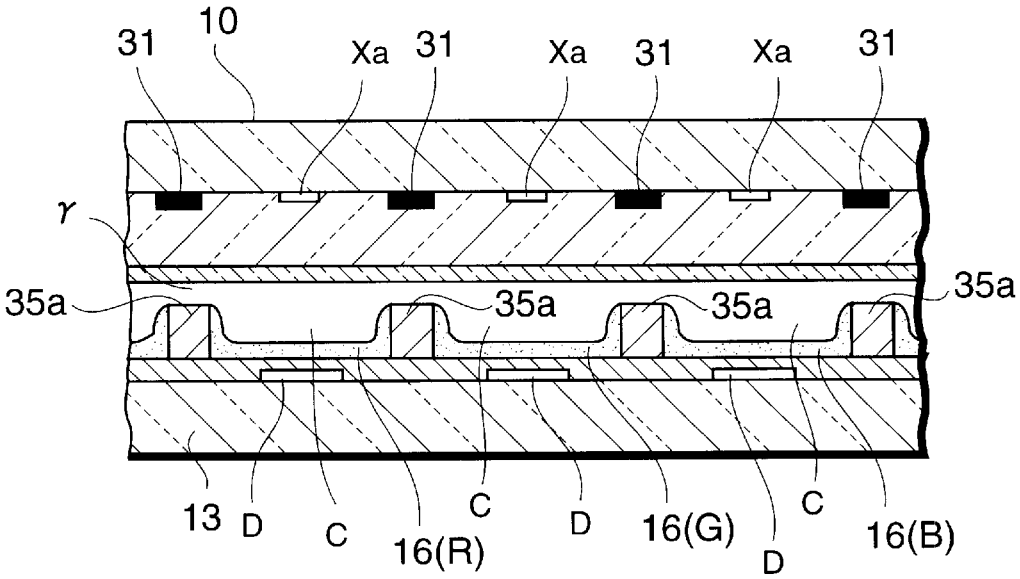
FIG. 4 is a sectional view taken along the W3—W3 line of FIG. 1.
Figure 5:
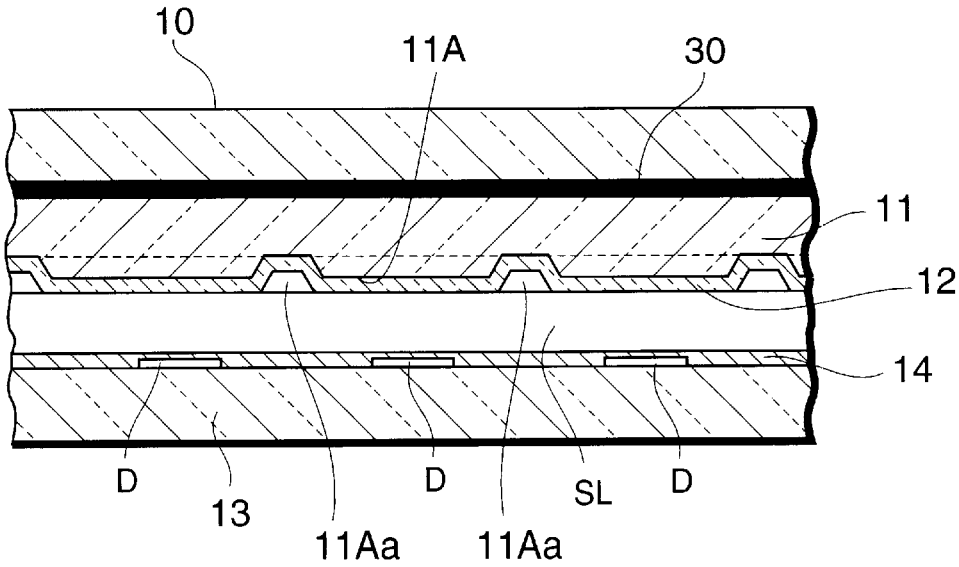
FIG. 5 is a sectional view taken along the W4—W4 line of FIG. 1.
Figure 6:
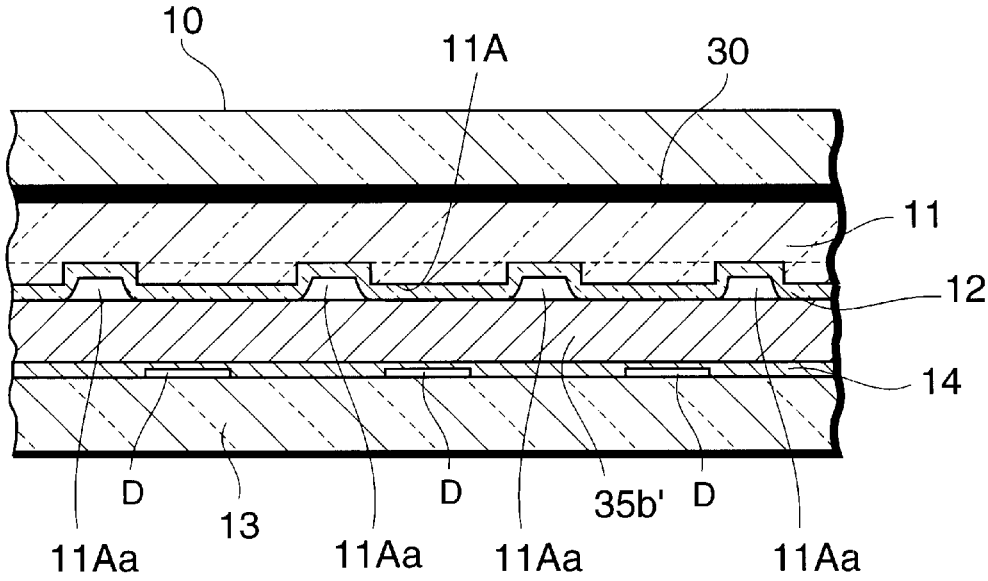
FIG. 6 is a sectional view taken along the W5—W5 line of FIG. 1.

FIG. 1 is a front view schematically presenting the PDP in the first example. FIG. 2 is a sectional view taken along the V3—V3 line of FIG. 1. FIG. 3 is a sectional view taken along the V4—V4 line of FIG. 1. FIG. 4 is a sectional view taken along the W3—W3 line of FIG. 1. FIG. 5 is a sectional view taken along the W4—W4 line of FIG. 1. FIG. 6 is a sectional view taken along the W5—W5 line of FIG. 1.

In the PDP shown in FIGS. 1 to 6, on a backside of a front glass substrate 10 serving as the display surface, a plurality of row electrode pairs (X, Y) are arranged in parallel to extend in the row direction (the traverse direction in FIG. 1) of the front glass substrate 10.

A row electrode X is composed of transparent electrodes Xa formed in a T-like shape of a transparent conductive film made of ITO or the like, and a bus electrode Xb which is formed of a metal film extending in the row direction of the front glass substrate 10 to connect to a proximal end of the narrowed portion of the transparent electrode Xa.

Likewise, a row electrode Y is composed of a transparent electrode Ya which is formed in a T-like shape of a transparent conductive film made of ITO or the like, and a bus electrode Yb which is formed of a metal film extending in the row direction of the front glass substrate 10 to connect to a proximal end of the narrowed portion of the transparent electrode Ya.

The row electrodes X and Y are alternated in the column direction (in the vertical direction in FIG. 1) of the front glass substrate 10. The transparent electrodes Xa and Ya arranged along the respective bus electrodes Xb and Yb, extend mutually toward a mate of the paired row electrodes such that the top sides (or the distal ends) of the wide portions of the transparent electrodes Xa and Ya mutually face on the opposite sides of a discharge gap g having a predetermined width.

Each of the bus electrodes Xb and Yb is formed in a double layer structure with a black conductive layer Xb' or Yb' on the display surface side and a main conductive layer Xb" or Yb" on the back surface side.

On the backside of the front glass substrate 10, a black light absorption layer (light-shield layer) 30 is formed between back-to-back oriented bus electrodes Xb and Yb of the respective row electrode pairs (X, Y) adjacent to each other in the column direction, to extend along the bus electrodes Xb and Yb in the row direction, and also a light absorption layer (light-shield layer) 31 is formed at parts facing a vertical wall 35*a* of a partition wall 35 (mentioned hereinafter).

A dielectric layer 11 is further formed on the backside of the front glass substrate 10 to overlay the row electrode pairs (X, Y) Furthermore, on the backside of the dielectric layer 11, an additional dielectric layer 11A is formed at in each position which opposes the adjacent bus electrodes Xb and Yb of the respective row electrode pairs (X, Y) adjacent to each other, plus which opposes an area between the adjacent bus electrodes Xb and Yb, to protrude from the backside of the dielectric layer 11 and to extend in parallel to the bus electrodes Xb, Yb.

On the backsides of the dielectric layer 11 and the additional dielectric layers 11A, a protective layer 12 made of MgO is formed.

Next, a back glass substrate 13 is arranged in parallel to the front glass substrate 10. On the front surface of the back glass substrate 13 facing toward the display surface, column electrodes D are disposed in parallel at regularly established intervals from one another to extend at positions opposing the transparent electrodes Xa and Ya of the respective pairs of the row electrodes (X, Y), in a direction orthogonal to the row electrode pair (X, Y) (the column direction).

A white dielectric layer 14 is further formed on the face of the back glass substrate 13 on the display surface side to overlay the column electrodes D, and the partition wall 35 is formed on the dielectric layer 14.

The partition wall 35 is formed in a ladder-like pattern by a vertical wall 35*a* extending in the column direction between the adjacent column electrodes D arranged in parallel to each other, and a transverse wall 35*b* extending in the row direction in a position opposing each additional dielectric layer 11A. The partition wall 35 in a ladder-like pattern defines the discharge space S between the front glass substrate 10 and the back glass substrate 13 into each area facing the paired transparent electrodes Xa and Ya of each row electrode pair (X, Y) to form quadrangular discharge cells C.

The transverse wall 35*b* of the partition wall 35 defining the discharge space S is divided by forming a clearance SL in a position thereof corresponding to the light absorption layer 30 between the display lines.

That is to say the partition wall 35 is formed in a ladder pattern along the direction of the display line L (the row direction), and in the column direction, the adjacent partition walls 35 are arranged in parallel to each other via the clearance SL extending along the display line L.

A width of the clearance SL is set such that each width of portions 35*b*' of the transverse wall 35*b* divided by the clearance SL formed between the display lines L is approximately equal to that of the vertical wall 35*a*.

On the five faces of a surface of the dielectric layer 14 and the side faces of the vertical walls 35*a* and the transverse walls 35*b* of the partition wall 35 facing the discharge space S, a phosphor layer 16 is formed to overlay all of them. The phosphor layers 16 are set in order of red (R), green (G) and blue (B) for the sequence of discharge cells in the row direction (see FIG. 4).

The inside of the discharge cell C is filled with a discharge gas.

The protective layer 12 overlaying the additional dielectric layer 11A is in contact with the surface of the transverse wall 35*b*' of the partition wall 35 on the display surface side (see FIG. 6). This allows the additional dielectric layer 11A to shield the adjacent discharge cells C from each other in the column direction. However, in the additional dielectric layer 11A, a groove 11A*a* is formed in a position lined up with the vertical wall 35*a* of the partition wall 35 in FIG. 1. The groove 11A*a* extends in the column direction and has both ends opened toward the top and bottom wall faces of the additional dielectric layer 11A and a free side on the back surface side (see FIGS. 5, 6).

Each discharge cell C communicates via the groove 11A*a* with the clearance SL formed between the transverse walls 35*b*' of the partition wall 35 arranged in the column direction.

The protective layer 12 is not in contact with the face of the vertical wall 35*a* of the partition wall 35 on the display surface side (see FIG. 4), and the clearance r is formed between the protective layer 12 and the vertical wall 35*a*. Therefore, the adjacent discharge cells C in the row direction are communicated via the clearance r with each other.

In the above PDP, each row electrode pair (X, Y) makes up a display line (row) L on a matrix display screen.

As in the conventional PDP, to form an image in the PDP, a reset discharge is first performed between the column electrodes D and the row electrodes X or Y in all the discharge cells so as to form wall charges on the surfaces of the dielectric layers 11 in all the discharge cells C.

Next, through address operation, the opposite discharge is produced selectively between the row electrode pair (X, Y) and the column electrode D in each discharge cell C, to scatter lighted cells (the discharge cells C in which the wall charge on the dielectric layer 11 is not cancelled) and nonlighted cells (the discharge cells C in which the wall charge on the dielectric layer 11 is cancelled), in all the display lines L over the panel in accordance with the image to be displayed.

After the address operation, in all the display lines L, the discharge sustain pulse is applied alternately to the row electrode pairs (X, Y) in unison. In each lighted cell, surface discharge is caused between the opposite transparent electrodes Xa and Ya for every application of the sustaining discharge pulse.

In this manner, the surface discharge in each lighted cell generates ultraviolet radiation, and thus the red, green and blue phosphor layers 16 formed in the discharge space S are individually excited to emit light, resulting in forming an image to be displayed.

The clearance r formed between the face of the vertical wall 35*a* of the partition wall 35 on the display surface side and the protective layer 12 overlaying the dielectric layer 11, serves for filling each discharge cell C with the discharge gas or removing the discharge gas from the discharge cell C.

This results in further securing, the priming effect of causing the discharge between the adjacent discharge cells C in the row direction such as in a chain reaction, or causing the discharge to transfer to the adjacent discharge cell C.

Also, since the additional dielectric layer 11A shields the adjacent discharge cells C in the column direction from each other, the discharge for forming an image is prevented from spreading into other discharge cells C adjacent thereto in the column direction to cause the false discharge. The groove 11A*a* formed in the additional dielectric layer 11A allows each discharge cell C to communicate with the inside of the clearance SL formed between the ladder-shaped partition walls 35. Therefore, priming particles (a pilot flame) are introduced from the clearance SL via the groove 11A*a* into the discharge cells C arranged in the column direction. Resulting in securing the priming effect in the column direction as in the case of that in the row direction.

Specifically, a drive pulse (a reset pulse applied to the column electrode D and the row electrode X or Y in the reset operation, a scan pulse applied to one of the row electrodes X, Y in the address operation, and a display data pulse applied to the column electrode D) is applied between the column electrode D and the row electrode X or Y, in order to cause a reset discharge in the reset operation (a discharge for temporarily forming wall charges in all the discharge cells C), and a selection discharge in the address operation (a discharge for selectively canceling the wall charge formed by the reset discharge in response to the display image data). At this time, occurrence of the discharge is facilitated because a discharge distance between the column electrode D and the row electrodes X, Y is shorter in the area where the additional dielectric layer 11A is formed. For this reason, the discharge is caused in the clearance SL between the column electrode D and the row electrodes X, Y.

Further, priming particles (a pilot flame) caused by the discharge in the clearance SL is scattered inside the adjacent discharge cells C in the column direction via the groove 11A*a*, to produce the priming effect of inducing the discharge between the adjacent discharge cells C.

The black or dark brown light-shield layer 30 is formed in an area of non-display line between the bus electrodes Xb and Yb, and black conductive layers Xb' and Yb' make up the respective faces of the bus electrodes Xb and Yb on the display surface side. This prevents reflection of ambient light to improve contrast. Moreover, even when the discharge for priming is caused between the column electrode D and the row electrodes X, Y in the clearance SL, the ambient light may not adversely affect the contrast on the images.

The PDP is configured such that the transverse wall 35*b* of the partition wall 35 defining the discharge space S is divided in the column direction by the clearance SL formed between the display lines, and each divided transverse wall 35*b*' is set to have approximately the same width as that of the vertical wall 35*a*. This reduces variations in shrinkage of the partition wall 35 in calcining. Hence, a warp in the front glass substrate 10 or the back glass substrate 13, failure of the partition wall 35 and so on may not cause deformation in configuration of the discharge cell.

Next, a second example of the embodiment according to the present invention will be described with reference to FIG. 7 to FIG. 9.

Figure 7:
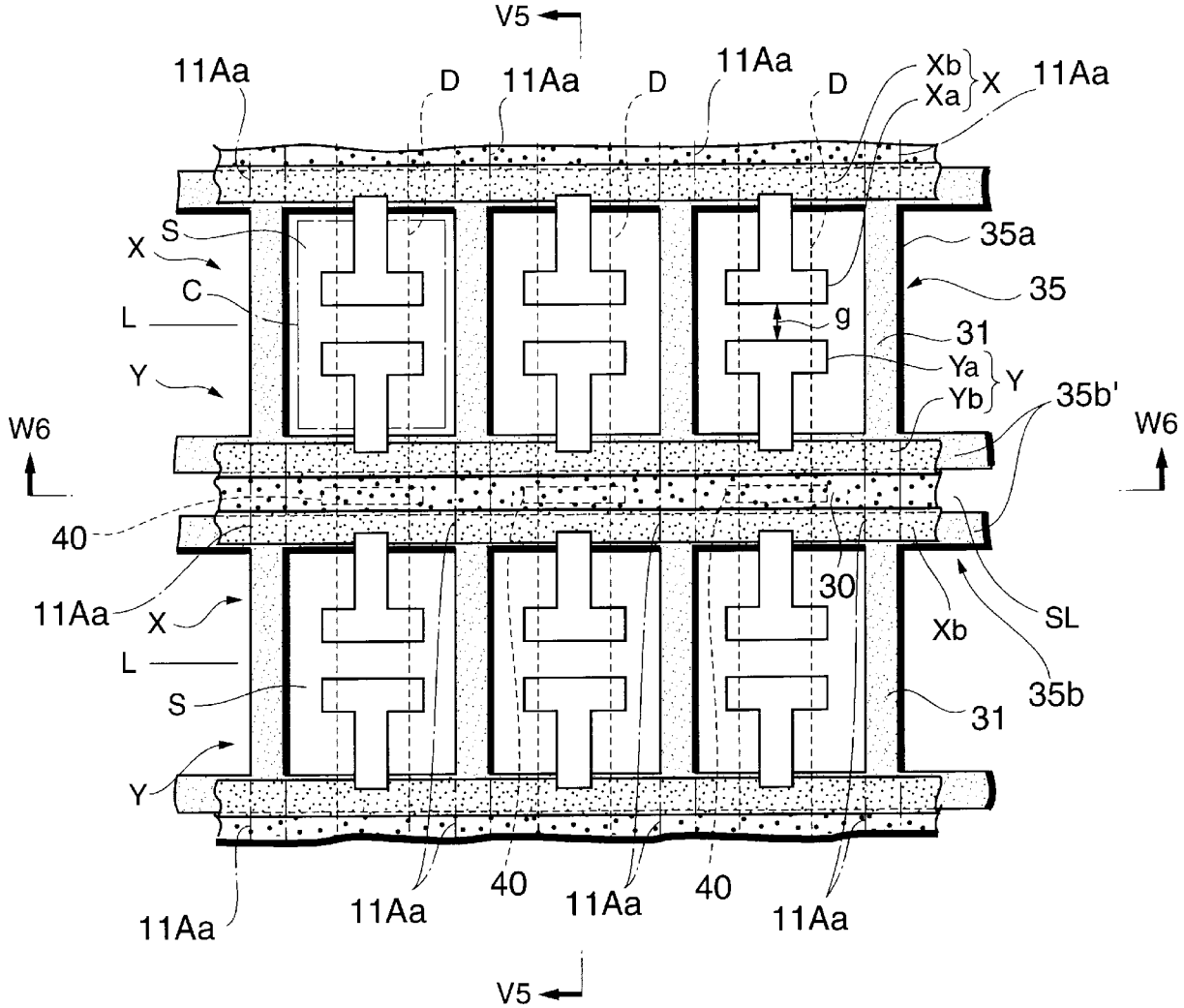
FIG. 7 is a front view schematically showing a second example according to the present invention.

FIG. 7 is a front view schematically presenting a PDP in the second example. FIG. 8 is a sectional view taken along the V5—V5 line of FIG. 7, and FIG. 9 is a sectional view taken along the W6—W6 line of FIG. 7.

Figure 8:
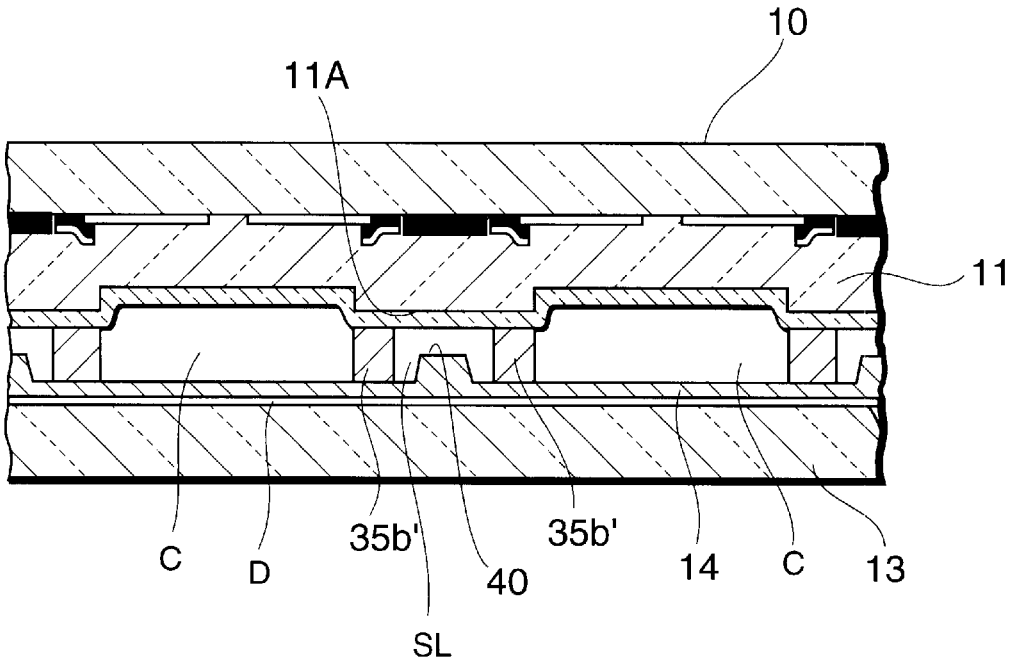
FIG. 8 is a sectional view taken along the V5—V5 line of FIG. 7.
Figure 9:
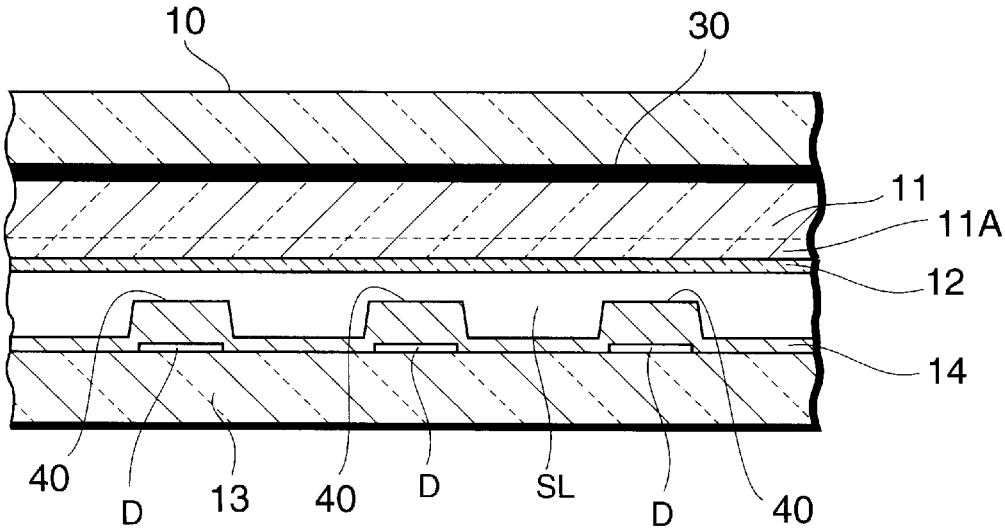
FIG. 9 is a sectional view taken along the W6—W6 line of FIG. 7.

A PDP illustrated in FIGS. 7 to 9 includes a dielectric rib 40 having a height shorter than that of the transverse wall 35*b*' and made of the same dielectric as that of the dielectric layer 14, on a portion of the dielectric layer 14 facing the column electrode D in the clearance SL.

The configuration of other parts of the PDP is the same as that of the PDP in the first example, so that the same reference numerals are used for designating them.

In the PDP of the second example, formation of the dielectric rib 40 in the clearance SL reduces the discharge distance between the column electrode D and the row electrodes X, Y. Therefore, occurrence of the discharge in the clearance SL is facilitated, resulting in further improving the priming effect in the column direction.

Figure 10:
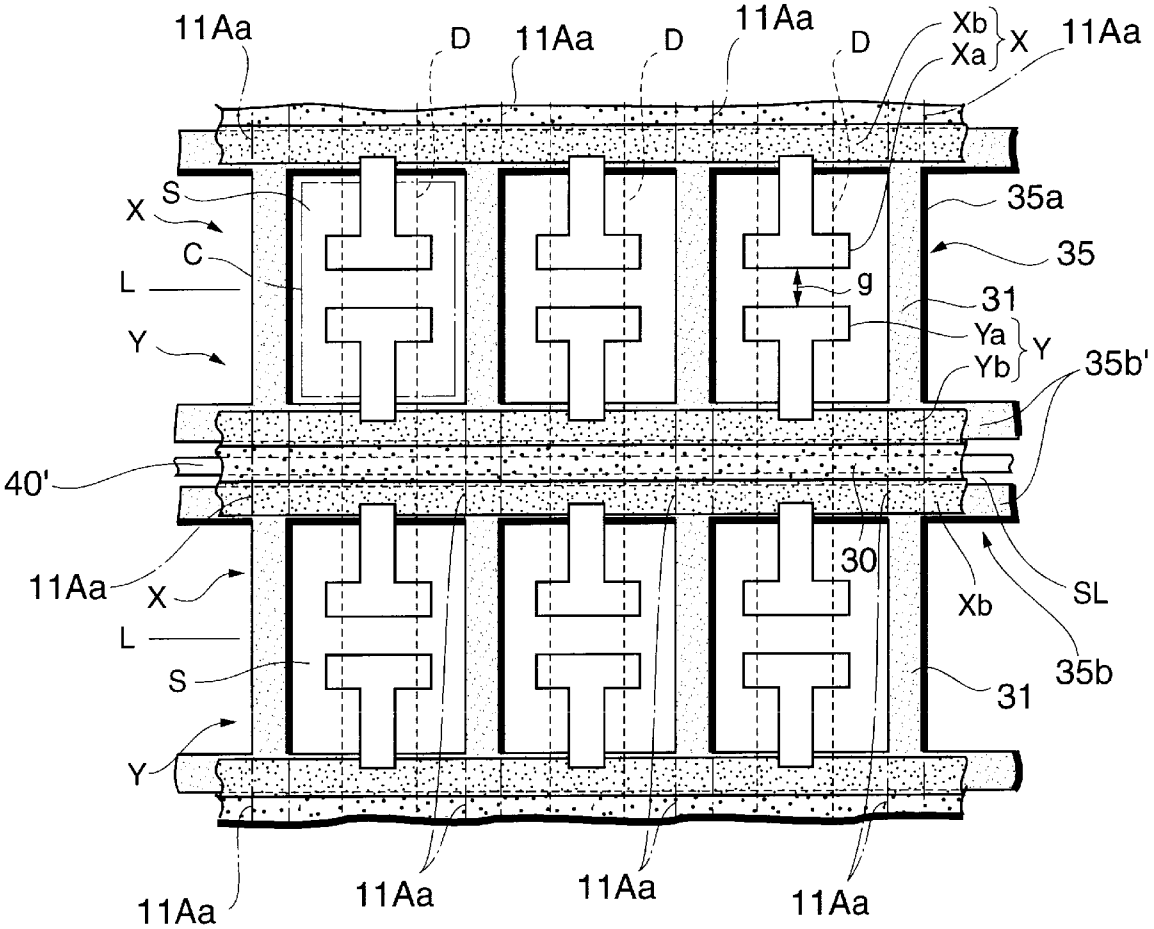
FIG. 10 is a front view schematically showing a modification example of the second example according to the present invention.

FIG. 7 illustrates the example when the dielectric rib 40 is formed in each column of the discharge cells C, but as shown in FIG. 10, a band-shaped dielectric rib 40' may be formed in the clearance SL to extend along the row direction.

Next, a third example of the embodiment according to the present invention will be described with reference to FIG. 11 and FIG. 12.

Figure 11:
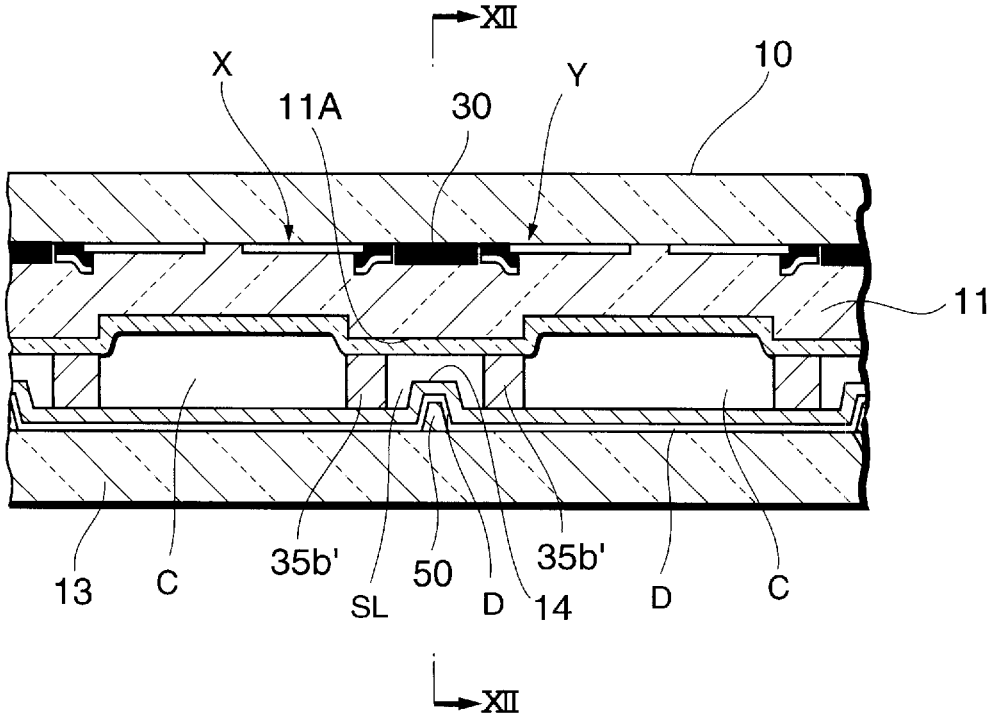
FIG. 11 is a sectional side view showing a third example according to the present invention.
Figure 12:
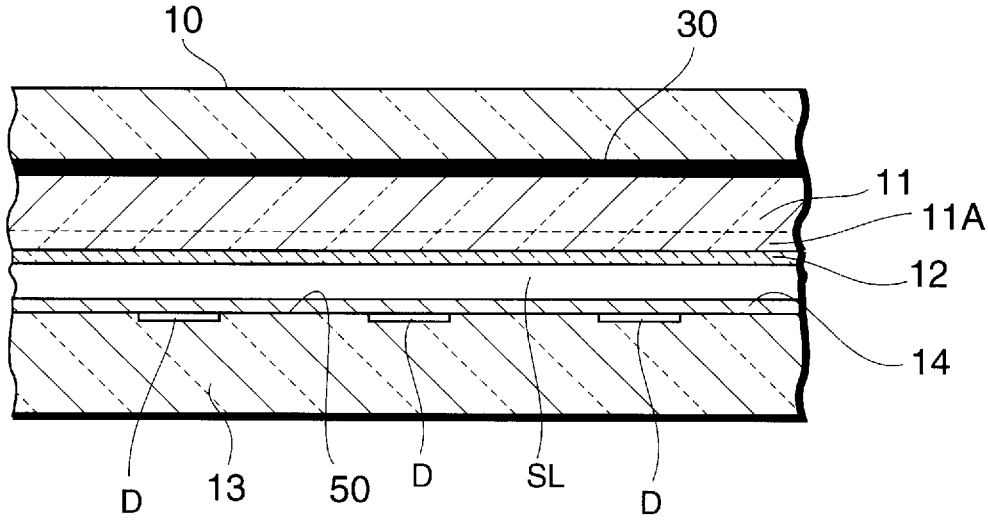
FIG. 12 is a sectional view taken along the XII—XII line of FIG. 11.

FIG. 11 is a sectional view corresponding to FIG. 8 (the sectional view taken along the V5—V5 line of FIG. 7), and FIG. 12 is a sectional view corresponding to FIG. 9 (the sectional view taken along the W6—W6 line of FIG. 7).

While the dielectric rib 40 of the PDP in the above second example is formed on the dielectric layer 14, in a PDP of the third example, a dielectric rib 50 is formed between the back glass substrate 13 and the column electrode D. In the portion where the dielectric rib 50 is formed, the column electrode D and the dielectric layer 14 overlaying the column electrode D rise toward the additional dielectric layer 11A.

The configuration of other parts of the PDP is the same as that of the PDP in the first example, so that the same reference numerals are used for designating them.

As in the second example, in the PDP of the third example, formation of the dielectric rib 50 in the clearance SL reduces the discharge distance between the column electrode D and the row electrodes X, Y. Therefore, occurrence of the discharge in the clearance SL is facilitated, resulting in further improving the priming effect in the column direction.

FIGS. 11 and 12 illustrate the example when the dielectric rib 50 is formed in a band-like shape in the clearance SL, but it may be formed in an island-like shape for each column of the discharge cells C.

Next, a fourth example of the embodiment according to the present invention will be described with reference to FIG. 13 and FIG. 14.

Figure 13:
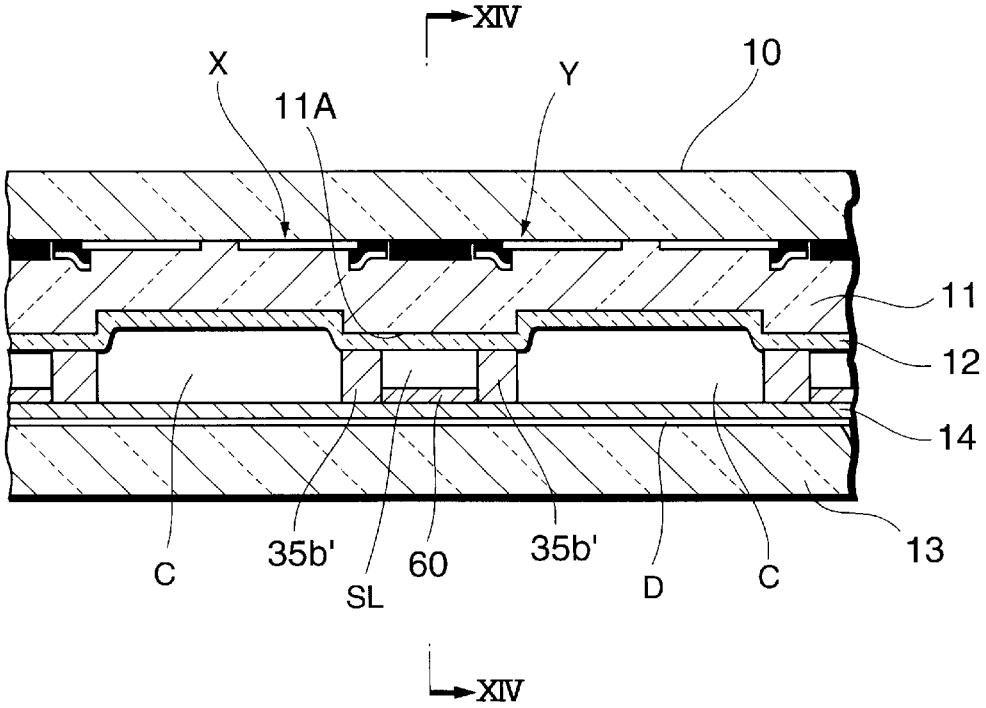
FIG. 13 is a sectional side view showing a fourth example according to the present invention.
Figure 14:
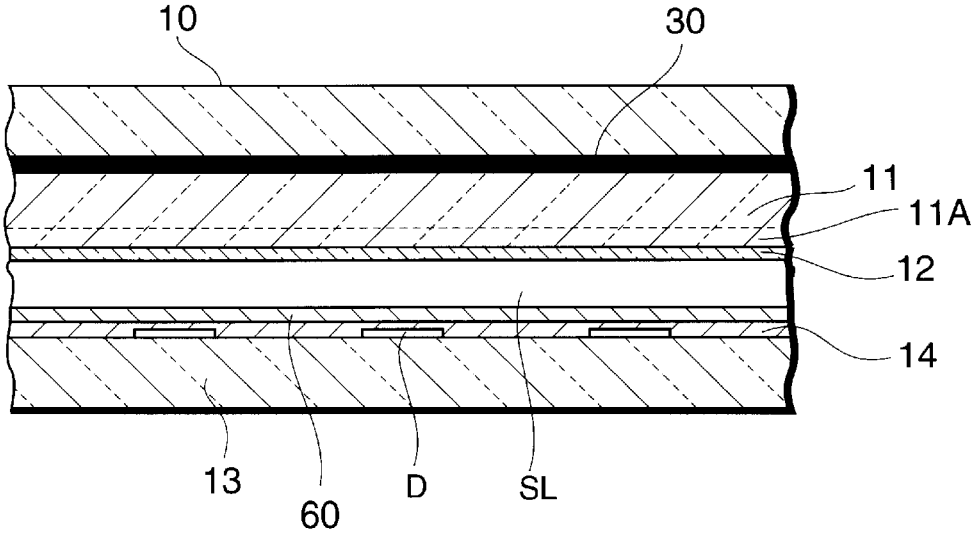
FIG. 14 is a sectional view taken along the XIV—XIV line of FIG. 13.

FIG. 13 is a sectional view corresponding to FIG. 8 (the sectional view taken along the V5—V5 line of FIG. 7), and FIG. 14 is a sectional view corresponding to FIG. 9 (the sectional view taken along the W6—W6 line of FIG. 7).

In a PDP of the fourth example, on a position on the dielectric layer 14 facing the column electrode D in the clearance SL, a high-γ layer 60 made of materials having a high coefficient of secondary electron emission such as MgO, CaO, is formed.

The high-γ layer 60 may be formed in a island-like shape or a band-like shape extending in the row direction, or formed to cover the entire surface of the dielectric layer 14.

The dielectric layer 14 may be made of a mixture including materials having a high coefficient of secondary discharge emission. Alternatively, the dielectric layer 14 or a column electrode protective layer itself may be a high-γ layer made of materials having a high coefficient of secondary electron emission.

With the PDP of the fourth example, occurrence of the discharge between the column electrode D and the row electrodes X, Y in the clearance SL is facilitated by the materials having a high coefficient of secondary electron emission making up the high-γ layer 60 formed in the clearance SL. Hence, the priming effect in the column direction is further improved.

Next, a fifth example of the embodiment according to the present invention will be described with reference to FIG. 15.

Figure 15:
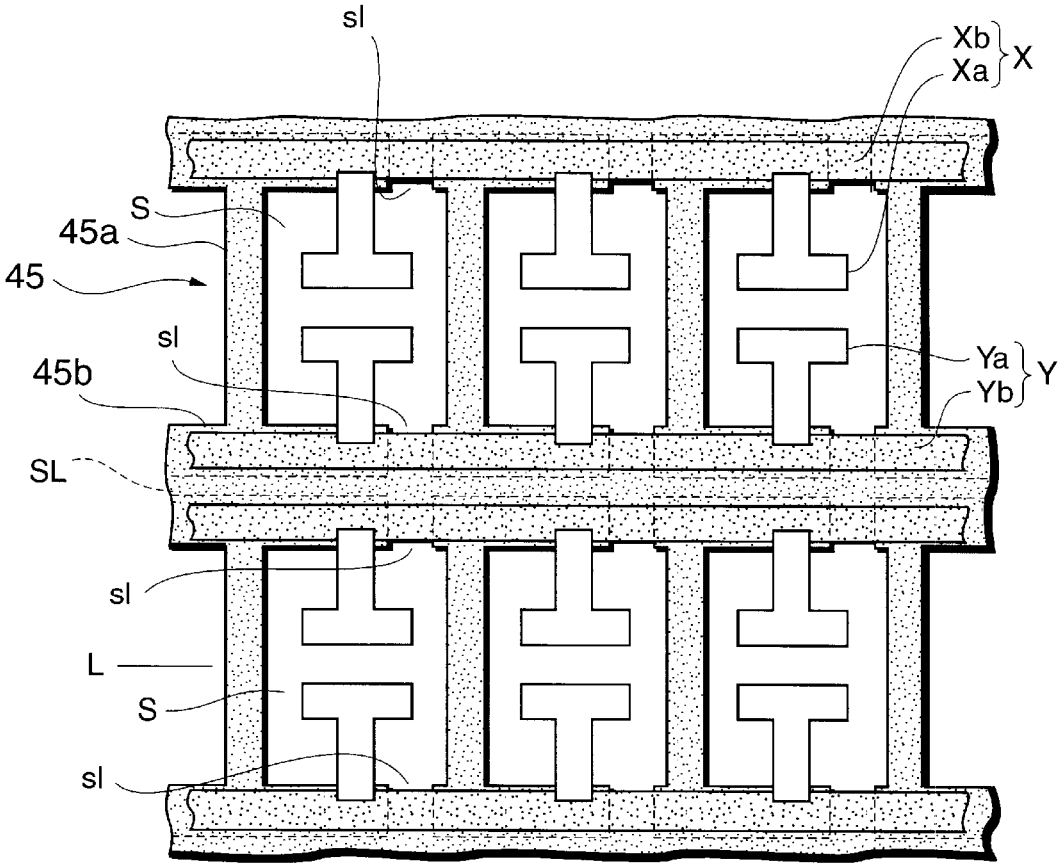
FIG. 15 is a front view schematically showing a fifth example according to the present invention.

FIG. 15 is a front view schematically showing a PDP in the fifth example.

In the PDP of the first to fourth examples, the communication between the clearance of the transverse wall of the partition wall and the discharge cell is established through the groove formed in the additional dielectric layer. In the PDP of the fifth example, however, a slit s1 is formed in a position in a transverse wall 45*b* of a ladder shaped partition wall 45 in which the transparent electrodes Xa, Ya do not respectively overlap the bus electrode Xb, Yb. The slit s1 allows communication between each discharge cell C and the clearance SL.

The configuration of other parts of the PDP is the same as that of the PDP in the first example, so that the same reference numerals are used for designating them.

As in the first example, in the PDP of the fifth example, when the images are formed, priming particles (a pilot flame) caused by the discharge caused in the clearance SL are scattered inside the adjacent discharge cells C in the column direction via the slit s1, to produce the priming effect of inducing the discharge between the adjacent discharge cells C.

It should be noted that in order to protect the function of the transverse wall 45*b*', of the partition wall 45 suppressing the spread of discharge from damage, the slit s1 is formed in the position in the transverse wall 45*a* of the partition wall 45 in which the transparent electrodes Xa, Ya do not respectively overlap the bus electrode Xb, Yb.

Next, a sixth example in the embodiment according to the present invention will be described with reference to FIG. 16.

Figure 16:
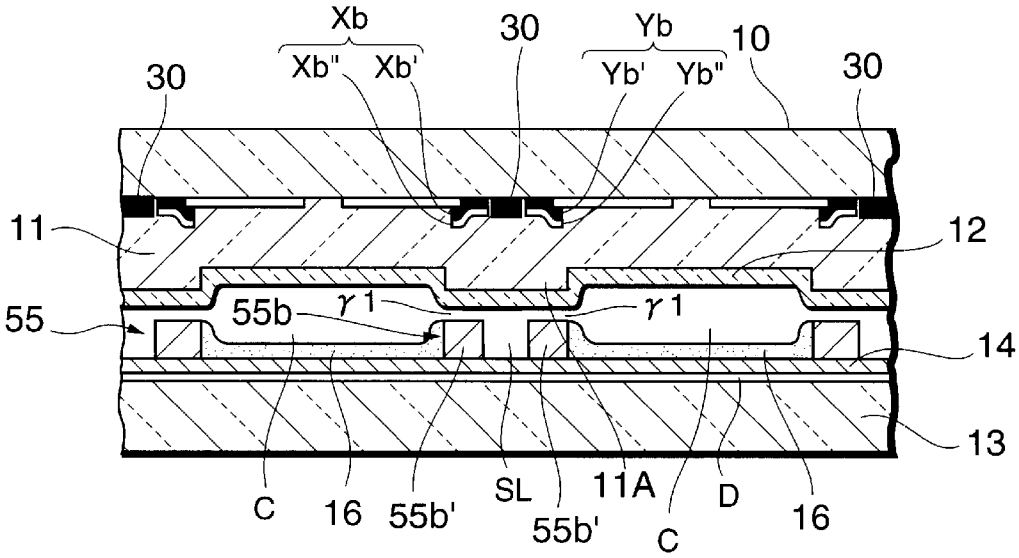
FIG. 16 is a sectional side view showing a sixth example according to the present invention.

FIG. 16 is a front view schematically illustrating a PDP in the sixth example.

The aforementioned PDP of the first example includes the groove formed in the additional dielectric layer for communication between the discharge cell and the clearance formed between the divided transverse walls of the partition wall. In the PDP of the sixth example, however, a height of a transverse wall 55*b*' of a partition wall 55 defining the discharge cell C is set has a smaller value than that of a space between the dielectric layer 14 and the protective layer 12 overlaying the additional dielectric layer 11A, thereby to form a clearance r1 between the protective layer 12 overlaying the additional dielectric layer 11A, and a face of the transverse wall 55*b*' on the display surface side.

The configuration of other parts of the PDP is the same as that of the PDP in the first example, so that the same reference numerals are used for designating them.

As in the first example, in the PDP of the sixth example, priming particles (a pilot flame) caused by the discharge in the clearance SL are scattered inside the adjacent discharge cells C in the column direction via the clearance r1, to produce the priming effect of inducing the discharge between the adjacent discharge cells C.

A position for forming the clearance r1 may be a part or all of the face of the transverse wall 55*b*' of the partition wall 55 facing the discharge cell C. In either of these two cases, the position should be set in such a position as to be able to prevent the surface discharge caused in a discharge cell C from spreading into another discharge cell adjacent thereto in the column direction. Similarly, vertical and transverse widths of the clearance r1 should be set in such a dimension as to be able to prevent the surface discharge from spreading into another discharge cell.

In the aforementioned fourth example shown in FIG. 13, instead of the high-γ layer 60, a phosphor layer emitting ultraviolet radiation may be formed on the dielectric layer 14 in the clearance SL.

In this case, through excitation by vacuum ultraviolet rays which is generated by xenon included in the discharge gas filled in the discharge space S upon discharge, ultraviolet radiation is emitted from the phosphor layer, and then generates secondary electrons in the discharge cell C, resulting in producing the priming effect.

Figure 17:
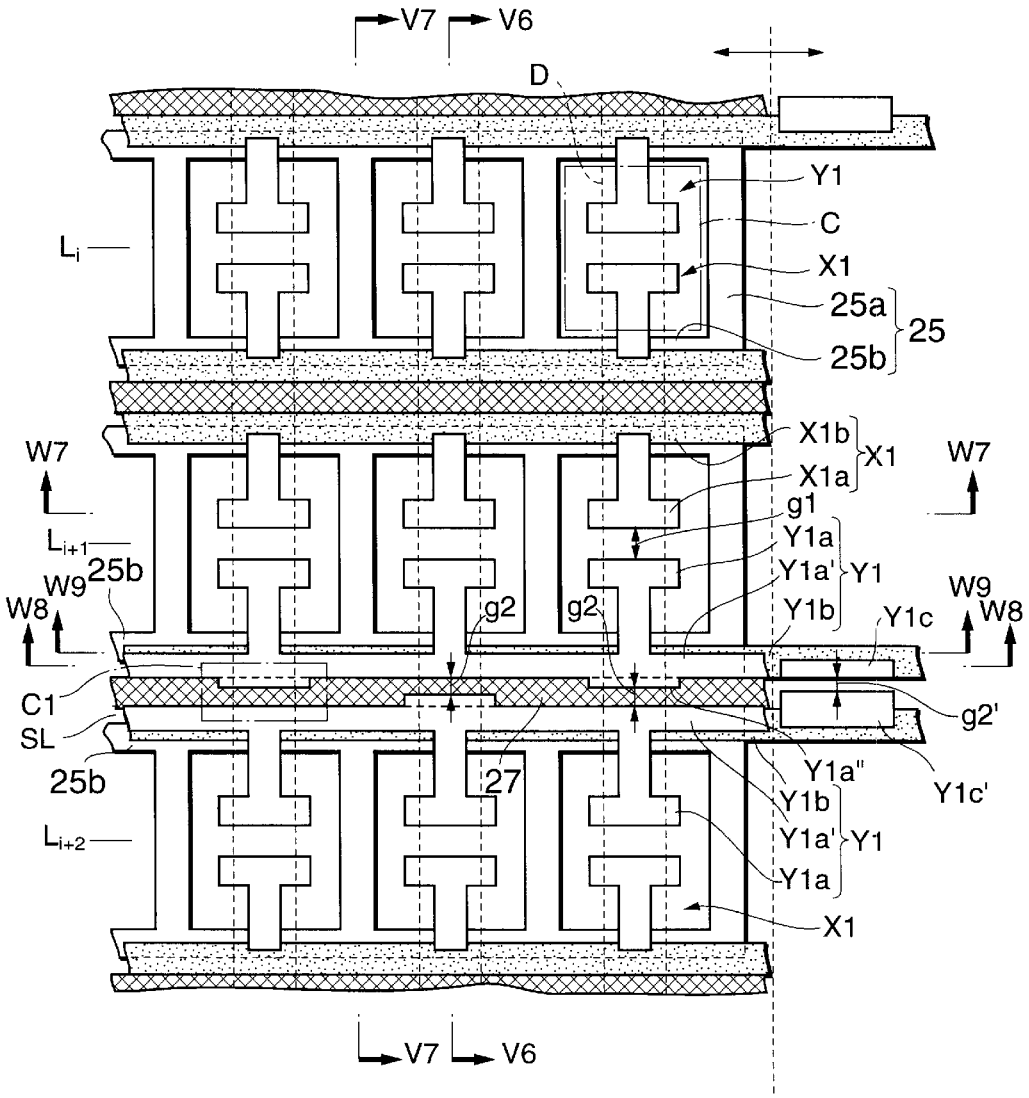
FIG. 17 is a front view schematically showing a seventh example according to the present invention.
Figure 18:
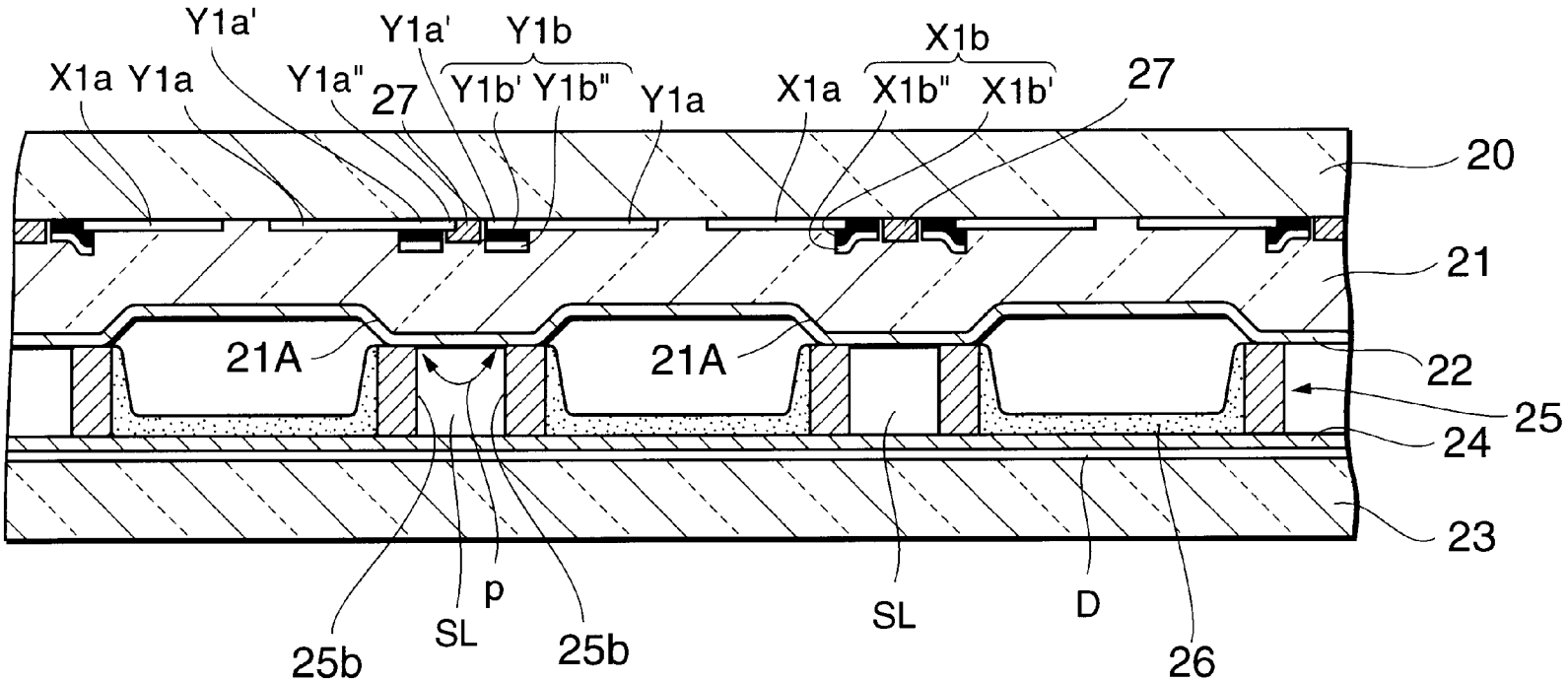
FIG. 18 is a sectional view taken along the V6—V6 line of FIG. 17.
Figure 19:
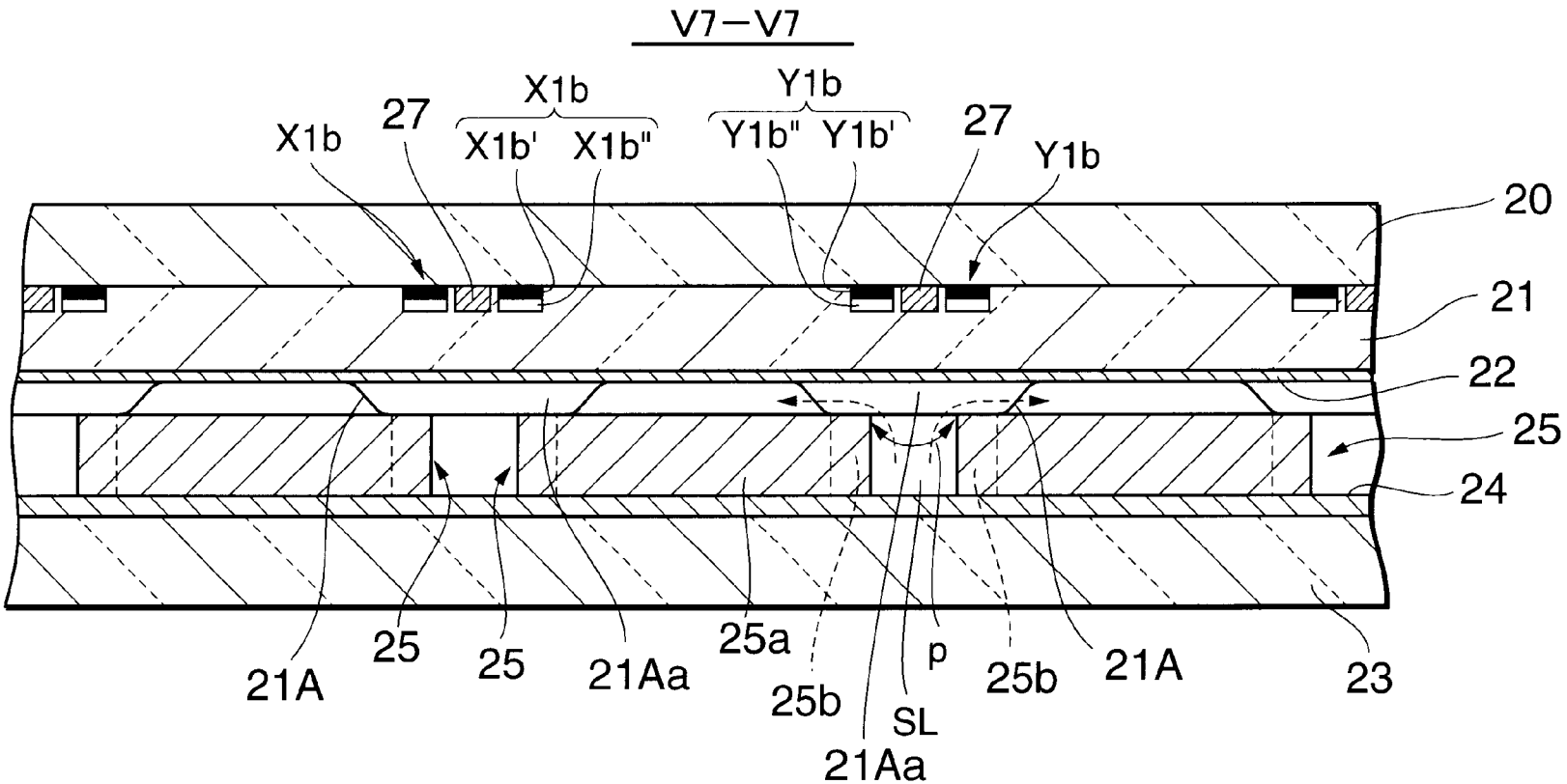
FIG. 19 is a sectional view taken along the V7—V7 line of FIG. 17.
Figure 20:
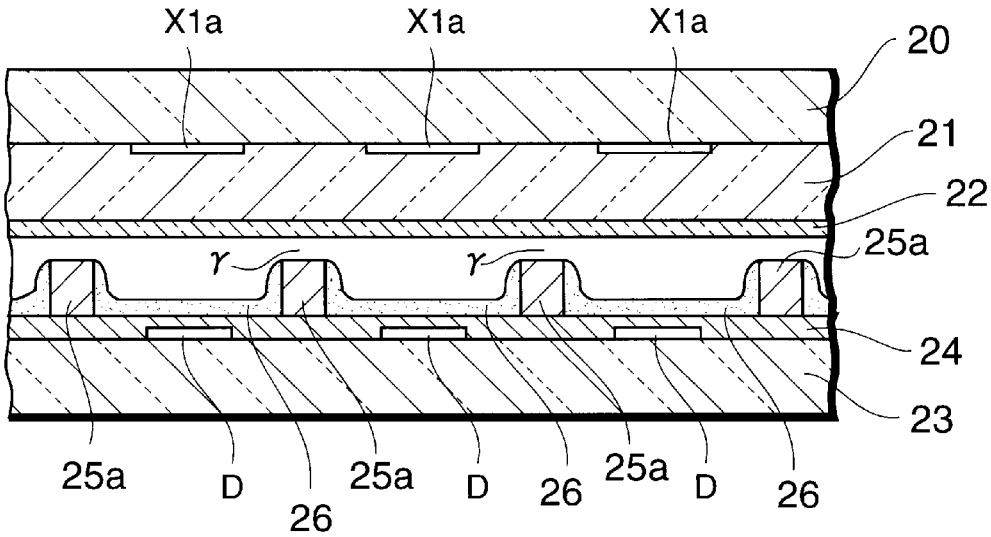
FIG. 20 is a sectional view taken along the W7—W7 line of FIG. 17.
Figure 21:
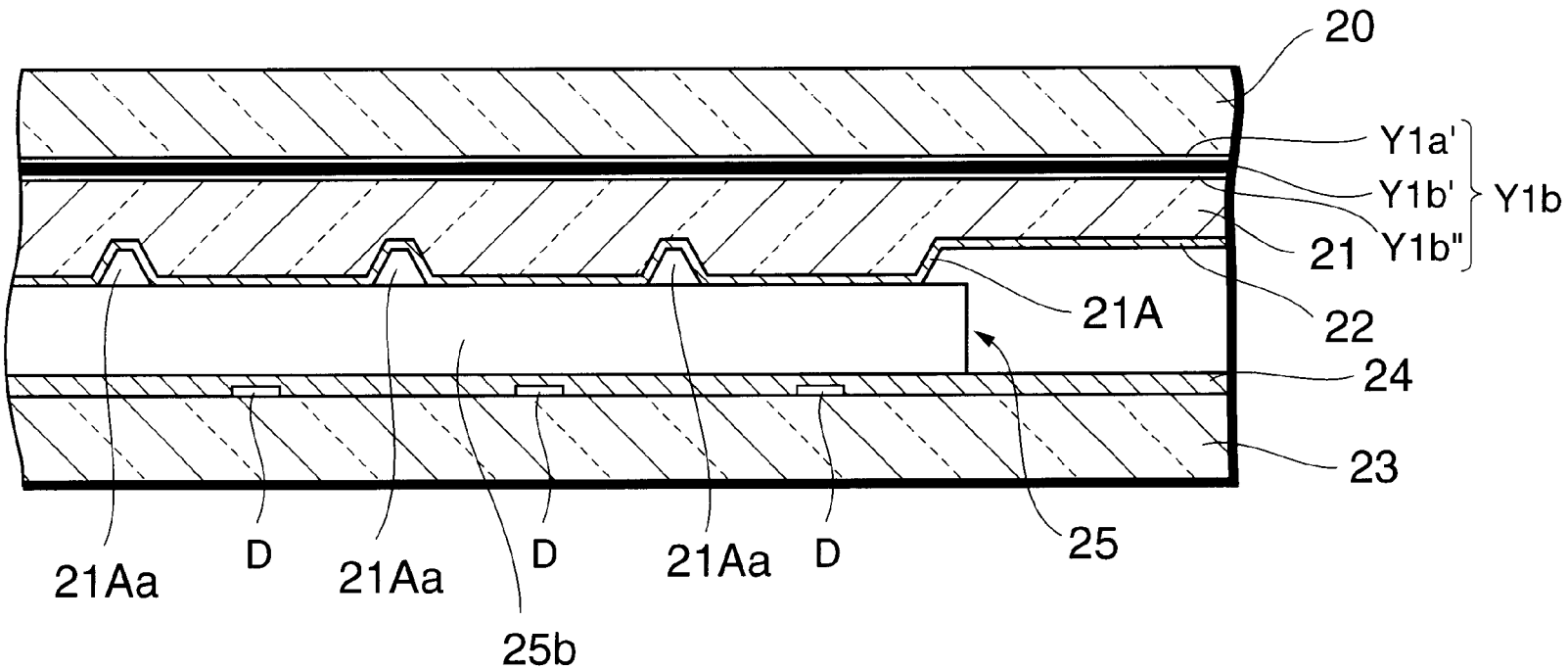
FIG. 21 is a sectional view taken along the W8—W8 line of FIG. 17.
Figure 22:
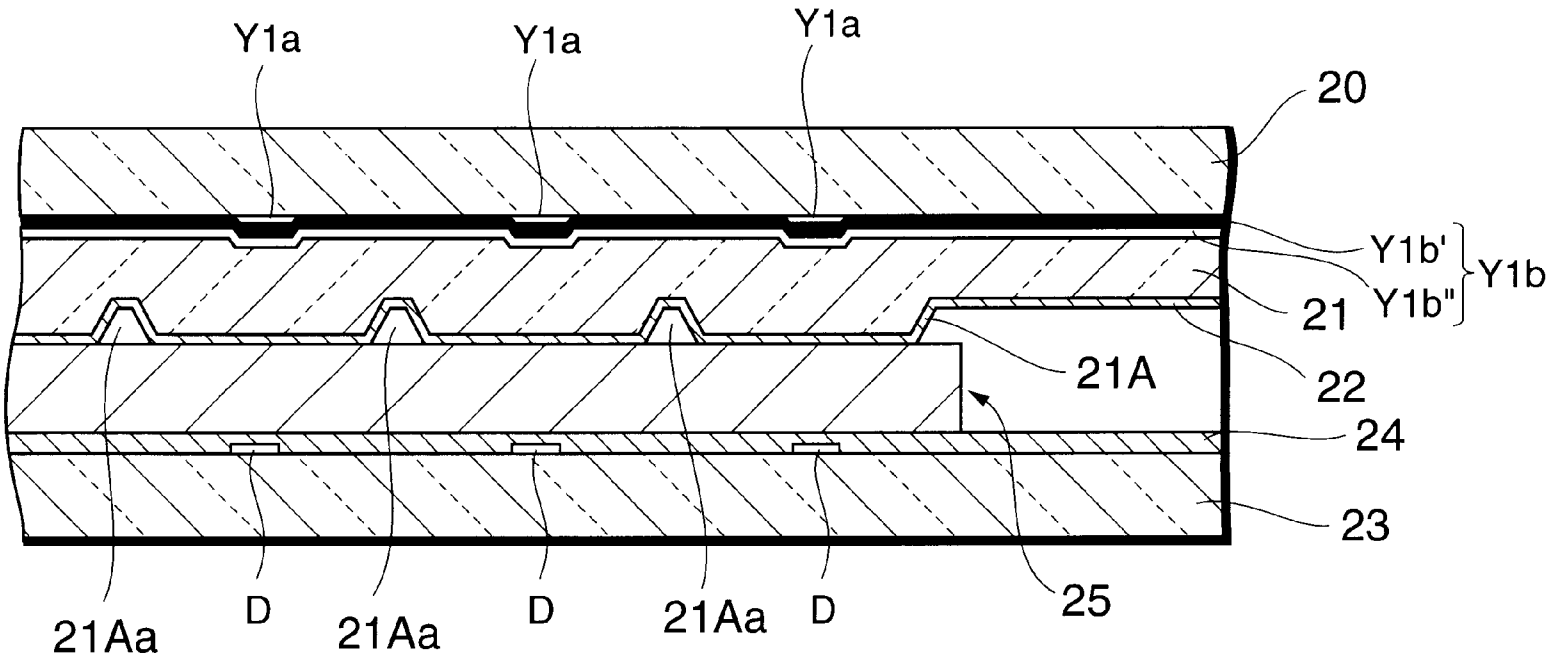
FIG. 22 is a sectional view taken along the W9—W9 line of FIG. 17.

FIGS. 17 to 22 illustrate a seventh example of the embodiment of the PDP according to the present invention. FIG. 17 is a front view schematically presenting the PDP in the seventh example. FIG. 18 is a sectional view taken along the V6—V6 line of FIG. 17. FIG. 19 is a sectional view taken along the V7—V7 line of FIG. 17. FIG. 20 is a sectional view taken along the W7—W7 line of FIG. 17. FIG. 21 is a sectional view taken along the W8—W8 line of FIG. 17. FIG. 22 is a sectional view taken along the W9—W9 line of FIG. 17.

In the PDP shown in FIG. 17 to FIG. 22, on a backside of a front glass substrate 20 serving as the display surface, a plurality of row electrode pairs (X1, Y1) are arranged in parallel to extend in the row direction (the traverse direction in FIG. 17) of the front glass substrate 20. Each pair of the row electrodes X1 and Y1 makes up a display line (row) Li of a matrix display.

A row electrode X1 is composed of transparent electrodes X1*a* formed in a T-like shape of a transparent conductive film made of ITO or the like, and a bus electrode X1*b* which is formed of a metal film extending in the row direction of the front glass substrate 20 to connect to a narrowed proximal-end of the transparent electrode X1*a*.

Likewise, a row electrode Y1 is composed of a transparent electrode Y1*a* which is formed in a T-like shape of a transparent conductive film made of ITO or the like, and a bus electrode Y1*b* which is formed of a metal film extending in the row direction of the front glass substrate 20 to connect to a narrowed proximal-end of the transparent electrode Y1*a*.

The transparent electrodes X1*a* of the row electrode X1 are separated from each other and individually connected to the bus electrode X1*b*, whereas the transparent electrodes Y1*a* of the row electrode Y1 are arranged such that each proximal end thereof is disposed to overlap the bus electrode Y1*b* and is connected to each other proximal ends through a transparent electrode main body Y1*a*' extending in the row direction.

The row electrodes X1 and Y1 are alternately interchanged in position in each display line, such as X1-Y1, Y1-X1.

In each row electrode pair (X1, Y1), the transparent electrodes X1*a* and Y1*a* arranged along the respective bus electrodes X1*b* and Y1*b*, extend mutually toward a mate of the paired row electrodes and the respective top sides of the wide portions (or the distal ends) mutually face via a discharge gap g1 having a predetermined width.

Further, in the back-to-back transparent electrode main bodies Y1*a*' of the row electrodes Y1 of the adjacent row electrode pairs (X1, Y1) in the column direction, a respective protrusion Y1*a*" is formed on a portion of one transparent electrode Y1*a* corresponding to the other transparent electrode Y1*a* on the opposite side in a staggered configuration, to protrude toward the other transparent electrode main body Y1*a*'. A leading end face of the one protrusion Y1*a*' faces a side face of the other transparent electrode main body Y1*a*' via a discharge gap g2, which is smaller in size than the discharge gap g1 formed between the transparent electrodes X1*a* and Y1*a*, in between.

In portions of the bus electrodes Y1*b* of the back-to-back row electrodes Y1 extending into the non-display area and opposing each other, priming discharge transparent electrodes Y1*c*, Y1*c*' are respectively formed to face each other with a discharge gap g2' in between.

The priming discharge transparent electrode Y1*c* is made of the same materials as those of the transparent electrode Y1*a* and the transparent electrode main body Y1*a*'. In the example illustrated in FIG. 17, a pair of opposite priming discharge transparent electrodes Y1*c*, Y1*c*' is formed in shape such that one priming discharge transparent electrode Y1*c*' protrudes toward the other priming discharge transparent electrode Y1*c*. However, if the discharge is easily caused, the priming discharge transparent electrode is not necessarily required to be made of the same materials as those of the transparent electrode Y1*a* or the transparent electrode main body Y1*a*' and the shape thereof can be selectively set.

Each of the bus electrodes X1*b* and Y1*b* is formed in a double layer structure with a black conductive layer X1*b*' or Y1*b*' on the display surface side and a main conductive layer X1*b*" or Y1*b*" on the back surface side.

On the backside of the front glass substrate 20, a black light absorption layer 27 is formed between the back-to-back bus electrodes X1*b* and X1*b* and between the back-to-back bus electrodes Y1*b* and Y1*b* of the respective row electrode pairs (X, Y) adjacent to each other, to extend along the row direction.

On the backside of the front glass substrate 20, a dielectric layer 21 is formed to overlay the row electrode pairs (X1, Y1). On the backside of the dielectric layer 21, an additional dielectric layer 21A is formed in each position which opposes the two back-to-back bus electrodes X1*b*, X1*b*, and the two back-to-back bus electrodes Y1*b*, Y1*b*, and areas between these back-to-bake bus electrodes X1*b*, X1*b* and Y1*b*, Y1*b*, to protrude from the backside of the dielectric layer 21.

On the backsides of the dielectric layer 21 and the additional dielectric layers 21A, a protective layer 22 made of MgO is formed.

Next, a back glass substrate 23 is arranged in parallel to the front glass substrate 20. On the front surface of the back glass substrate 23 on the display surface side, column electrodes D are disposed at regularly established intervals from one another to extend at positions, opposing the transparent electrodes X1*a* and Y1*a* of the respective pairs of the row electrodes (X1, Y1), in a direction orthogonal to the row electrode pair (X1, Y1) (the column direction).

On the face of the back glass substrate 23 on the display surface side, a white dielectric layer 24 is further formed to overlay the column electrodes D, and a partition wall 25 is formed on the dielectric layer 24.

The partition wall 25 is formed in a ladder-like pattern by a vertical wall 25*a* extending in the column direction between the adjacent column electrodes D arranged in parallel to each other, and a transverse wall 25*b* extending in the row direction in a position opposing each additional dielectric layer 21A. The ladder-like shaped partition wall 25 defines the discharge space S between the front glass substrate 20 and the back glass substrate 23 into each area facing the paired transparent electrodes X1*a* and Y1*a* in each row electrode pair (X1, Y1) to form quadrangular discharge cells C.

The partition wall 25 defining the discharge space S is arranged to form a clearance SL extending in the row direction between the walls of the partition wall 25, namely, it is arranged in the column direction in a state in which the adjacent transverse walls 25*b* of the partition wall 25 face each other via the clearance SL.

The clearance SL is situated in each position which opposes two each of the back-to-back bus electrodes X1*b* and Y1*b*, and areas between these back-to-bake bus electrodes X1*b* and Y1*b*. Therefore, a priming discharge cell C1 is formed in an area in the clearance SL opposing the discharge gap g2 located between the protrusion Y1*a*" of the transparent electrode Y1*a* and the adjacent transparent electrode main body Y1*a*'.

On the five faces of a surface of the dielectric layer 24 and the side faces of the vertical walls 25*a* and the transverse walls 25*b* of the partition wall 25 facing the discharge space S, a phosphor layer 26 is formed to overlay all of them. The phosphor layers 26 are set in order of red (R), green (G) and blue (B) for the sequence of discharge cells in the row direction.

The inside of the discharge cell C is filled with a discharge gas.

The protective layer 22 overlaying the additional dielectric layer 21A is in contact with the surface of the transverse wall 25*b* of the partition wall 25 on the display surface side. This allows the additional dielectric layer 21A to shield the adjacent discharge cells C from each other in the column direction.

However, a groove 21A*a* is formed at a position of the additional dielectric layer 21A lined up with the vertical wall 25*a* of the partition wall 25 in FIG. 17. The groove 21A*a* extends in the column direction and has both ends opened toward the top and bottom wall faces of the additional dielectric layer 21A and a free side on the back surface side (see FIGS. 19, 21 and 22). Each discharge cell C communicates via the groove 21A*a* with the clearance SL formed between the transverse walls 25*b* of the partition wall 25 aligned in the column direction.

The protective layer 22 is not in contact with the face of the vertical wall 25*a* of the partition wall 25 on the display surface side (see FIG. 20), and the clearance r is formed between the protective layer 22 and the vertical wall 25*a*. Therefore, the adjacent discharge cells C in the row direction are communicated via the clearance r with each other.

The images are displayed on the above PDP as follows.

Figure 23:
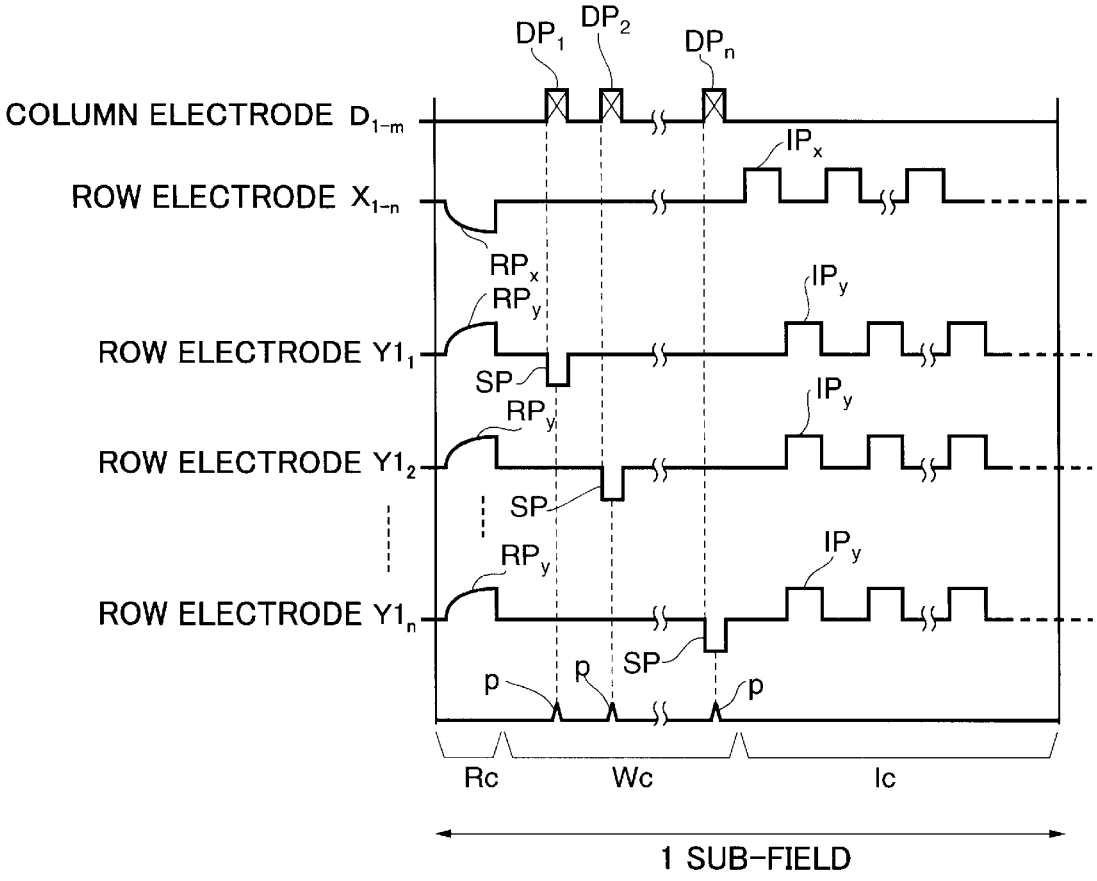
FIG. 23 is a timing chart showing an occurrence status of the priming discharge in the seventh example.

As illustrated in FIG. 23, first, reset pulses RPx, RPy are respectively applied to the row electrodes X1, Y1 in a reset period Rc in unison, to cause reset discharge between the column electrode D and the row electrode X1 or Y1 in all the discharge cells so as to form wall charges on the surfaces of the dielectric layers 21 in all the discharge cells C.

Next, through address operation in linear order in an address period Wc, upon application of a scan pulse SP to the row electrode Y1 in each discharge cell C, the opposite discharge (selection discharge) is performed selectively between the transparent electrode Y1*a* and the column electrode D. Thus, lighted cells (the discharge cells C in which the wall charge on the dielectric layer 11 is not cancelled) and nonlighted cells (the discharge cells C in which the wall charge on the dielectric layer 11 is cancelled), are scattered in all the display lines Li over the panel in accordance with the image to be displayed.

At this time, in the priming discharge cell C1 in the clearance SL, when the scan pulse SP is applied to each row electrode Y1, the priming discharge p is caused between the protrusion Y1*a*" and the adjacent transparent electrode main body Y1*a*', facing each other via the discharge gap g2.

Priming particles (a pilot flame) are caused by priming discharge p in the priming discharge cell C1, and diffuse in the discharge cells C both adjacent to the priming discharge cell C in the column direction, via the respective grooves 21A*a* formed in the additional dielectric layer 21A.

After the address operation, sustaining discharge pluses IPx, IPy are applied alternately to the row electrodes X1, Y1 in all the display lines Li in unison in a sustaining discharge period Ic. In each lighted cell, surface discharge (sustaining discharge) is caused between the transparent electrodes X1*a* and Y1*a* opposing each other for every application of the sustaining discharge pulses IPx, IPy.

In this manner, the surface discharge in each lighted cell generates ultraviolet radiation, and thus the red, green and blue phosphor layers 26 of the primary colors in the discharge space S are individually excited to emit light, resulting in forming the display image.

In the sustaining discharge period Ic, due to the priming particles (a pilot flame) which is caused in the clearance SL by the priming discharge p in the address period Wc and diffusing into each lighted cell via the groove 21A*a* of the additional dielectric layer 21A, the sustaining discharge for forming the image is induced to exert the priming effect.

As described above, in order to prevent false discharge from occurring between the adjacent discharge cells C in the column direction, the additional dielectric layer 21A is formed shield the adjacent discharge cells C in the column direction from each other. Accordingly, it is not needed to increase a discharge delay time for the selection discharge in the address period Wc, and also to increase a pulse width of the scan pulse for stabilizing the selection discharge.

As a result, it is possible to reduce percentages of the address period Wc making up a field, and increase the number of sub-fields for increase of the number of gradations. It is also possible to increase the number of sustaining discharge pulses IPx, IPy in each sub-field for improvement of brightness.

Further, in the above PDP, the priming discharge is also caused in the address period Wc between a pair of priming discharge transparent electrodes Y1*c* and Y1*c*' which are respectively provided in the two back-to-back bus electrodes Y1*b* in the non-display area of the PDP and face each other via the discharge gap g2', resulting in enhancement of the priming effect as described above.

In this way, in the non-display area of the PDP where it is convenient to secure the discharge space for the priming discharge, the priming discharge transparent electrode Y1*c* is provided to cause the priming discharge. Thereby, the priming discharge transparent electrode having a different structure from that of the inside of the display area can be provided for facilitating occurrence of the priming discharge. This allows further enhancement of the priming effect.

Figure 24:
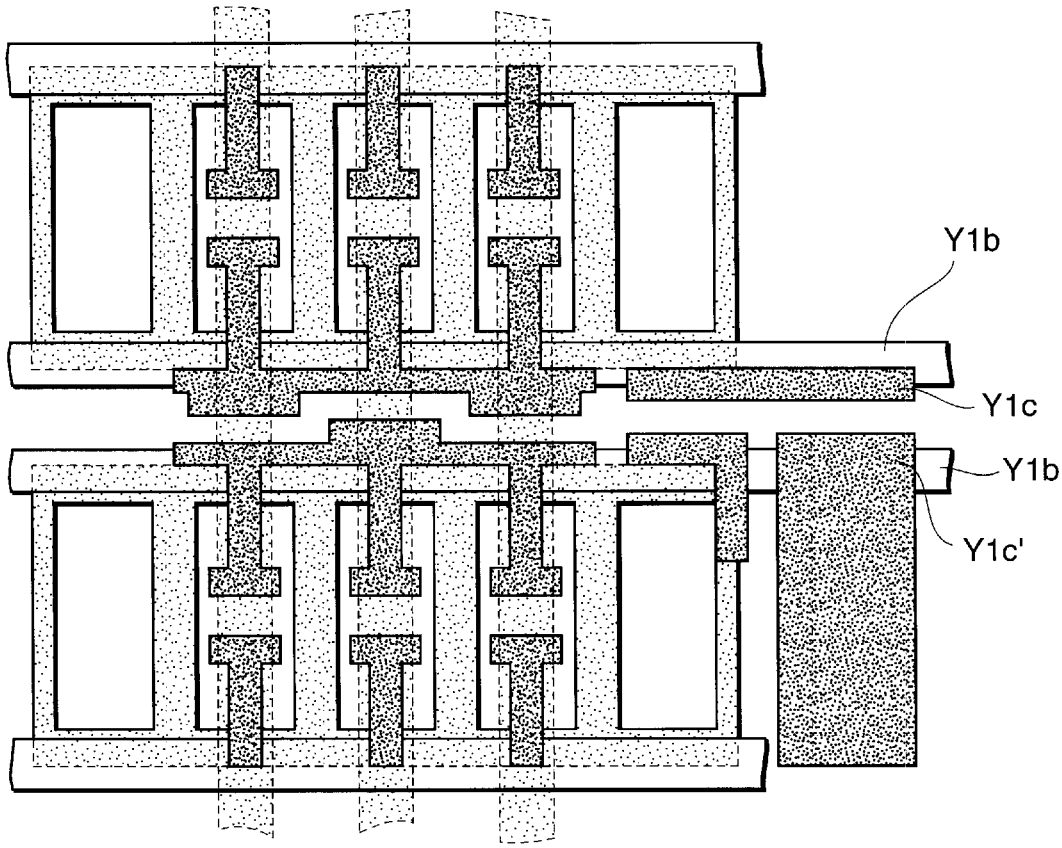
FIG. 24 is a front view schematically showing a modification example of a priming discharge section formed in a non-display area on a plasma display panel of the seventh example.

For example, as illustrated in FIG. 24, the priming discharge transparent electrode Y1*c*' facing the other priming discharge transparent electrode Y1*c* is designed to increase in size larger than the priming discharge transparent electrode Y1*c*. Employing such a way or the like allows occurrence of the priming discharge with reliability.

The above PDP ensures the reliable occurrence of the priming discharge by means of setting the discharge gap g2 and g2' in which the priming discharge is caused, to be smaller in size than the discharge gap g1 formed between the transparent electrodes X1*a* and Y1*a* in each discharge cell C.

Further, in the above PDP, the black conductive layer Y1*b*' makes up the faces, on the display surface side, of the two bus electrodes Y1*b* situated at a position facing the opening of the clearance SL, and also the light absorption layer 27 is arranged between the two bus electrodes Y1*b*. Accordingly, as seen from the display surface of the front glass substrate 20, the PDP is structured such that a black layer absorbing light covers all the openings of the clearances SL. For this reason, it is prevented that light emission by the priming discharge p in the clearance SL situated in the non-display line adversely affects contrast on the image.

Still further, in the above PDP, positions of the row electrodes X1 and Y1 are alternately interchanged in each display line Li in such a manner to arrange X1-Y1, Y1-X1, and the two row electrodes Y1 adjacent to each other with orientation in the opposite direction make up the priming discharge cell C1. For this reason, a potential difference occurs between the discharge gaps g2 and g2' when the sustaining discharge is performed in unison in the sustaining discharge period Ic, resulting in preventing decrease in efficiency of the sustaining discharge in the discharge cell C.

However, the arrangement of the row electrodes X1 and Y1 of each row electrode pair (X1, Y1) may be the normal arrangement of X1-Y1, X1-Y1. In this case, the priming discharge is caused for every application of the reset pulses RPx, RPy, the scan pulse SP, and the sustaining discharge pulse IPx, IPy.

In the above PDP, a shape and arrangement of the protrusion Y1*a*" of each row electrode Y1, a size of the discharge gap g2, and so on can be arbitrarily set to secure the priming discharge p.

The foregoing description shows the example where the groove 21A*a* is formed in the additional dielectric layer 21A to allow the discharge cell C to communicate with the priming discharge cell C1 in the clearance SL. However, a communicating section for communication between the discharge cell C and the inside of the clearance SL may be formed in the vertical wall 25 of the partition wall 25. Alternatively, a portion of the transverse wall 25*b* may be decreased in height to be lower than that of the vertical wall 25*a*, to allow communication between the discharge cell C and the inside of the clearance SL.

Figure 25:
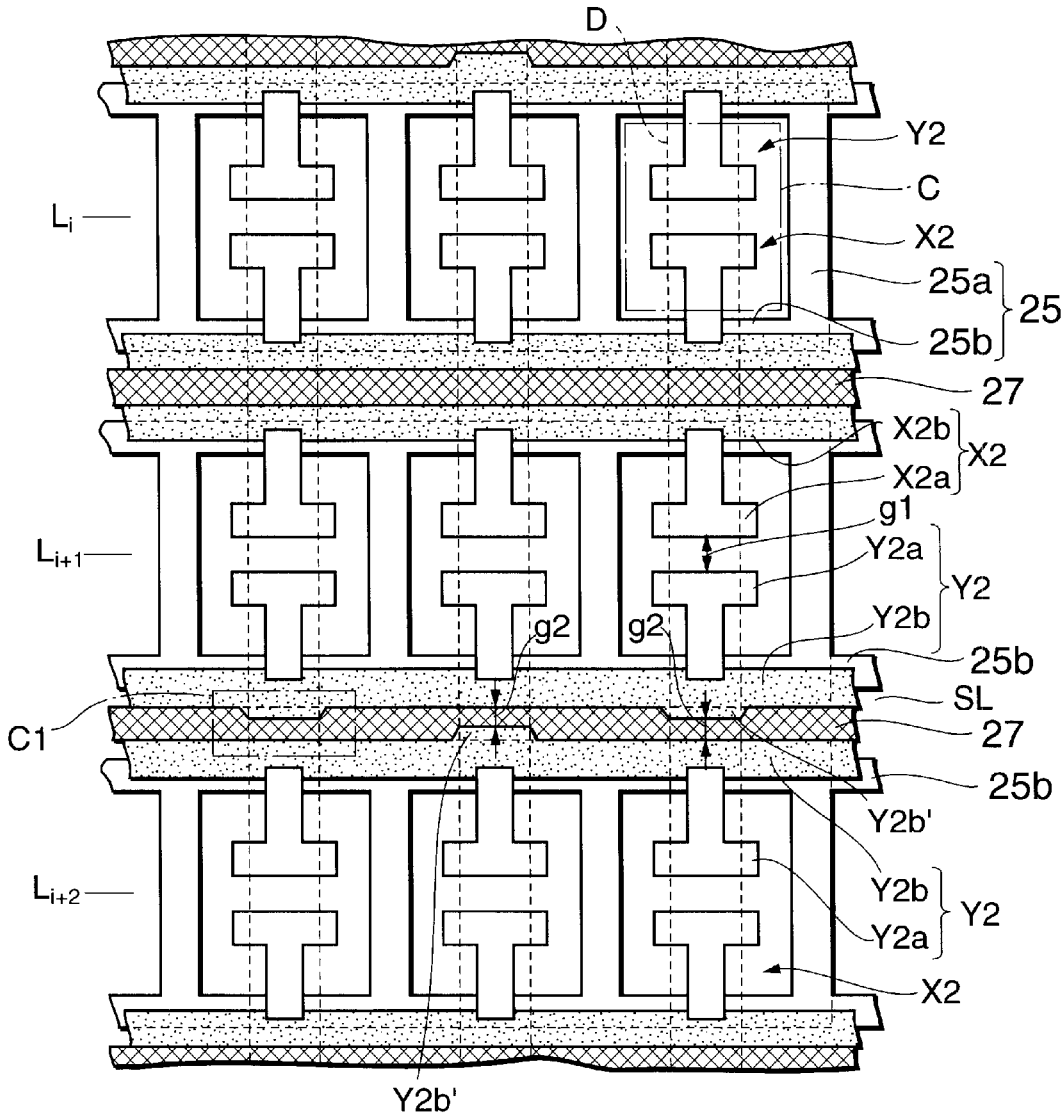
FIG. 25 is a front view schematically showing an eighth example according to the present invention.

FIG. 25 is a front view schematically showing an eighth example of the embodiment according to the present invention.

The PDP of the seventh example is configured such that the priming discharge cell C1 is provided in the clearance SL by patterning the transparent electrode Y1*a*. However, in a PDP in the eighth example, a bus electrode Y2*b* of a row electrode Y2 is patterned to form a priming discharge cell C1 in a clearance SL as in the seventh example.

Figure 30:
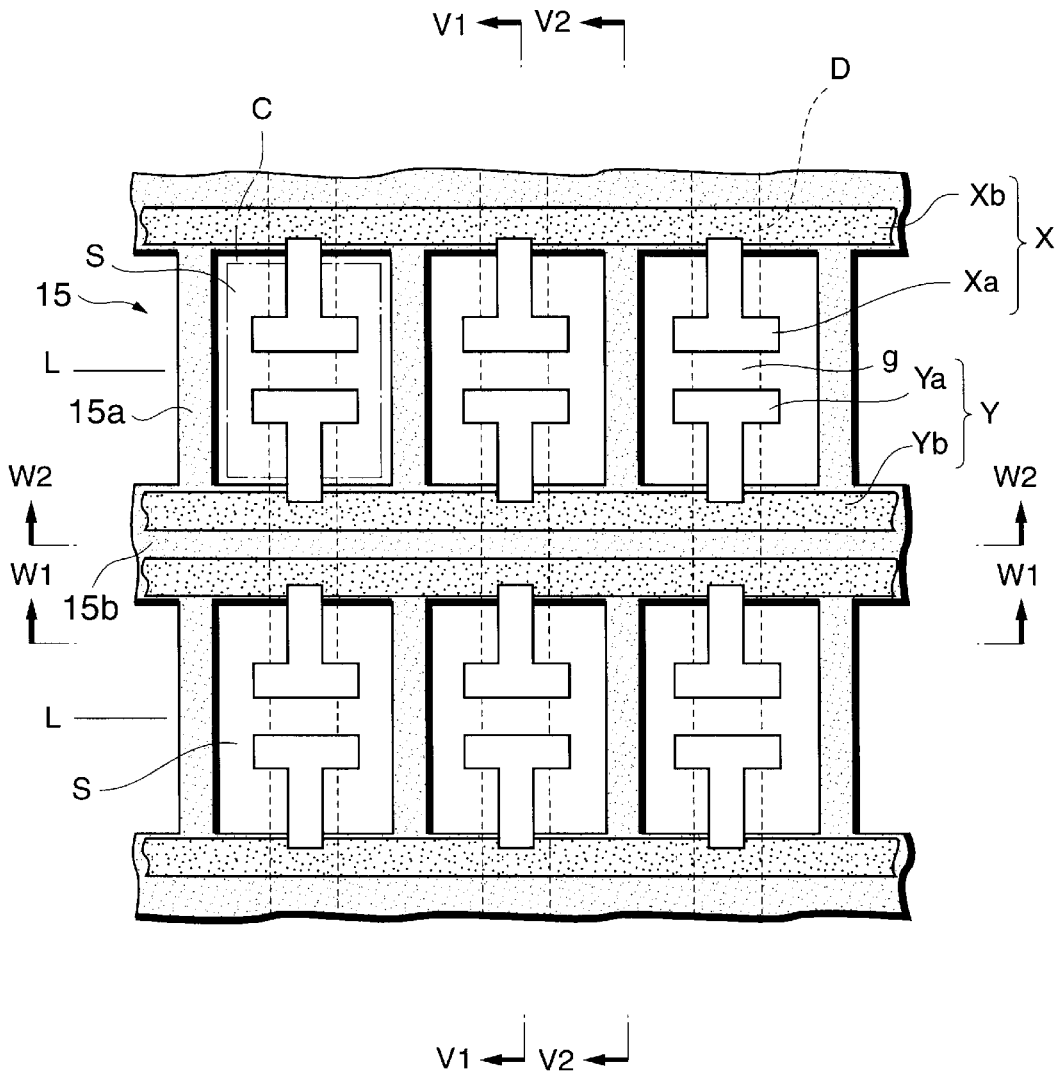
FIG.30 PRIOR ART
FIG. 30 is a front view schematically showing the PDP according to the suggestion prior to the present invention of the applicant.
Figure 31:
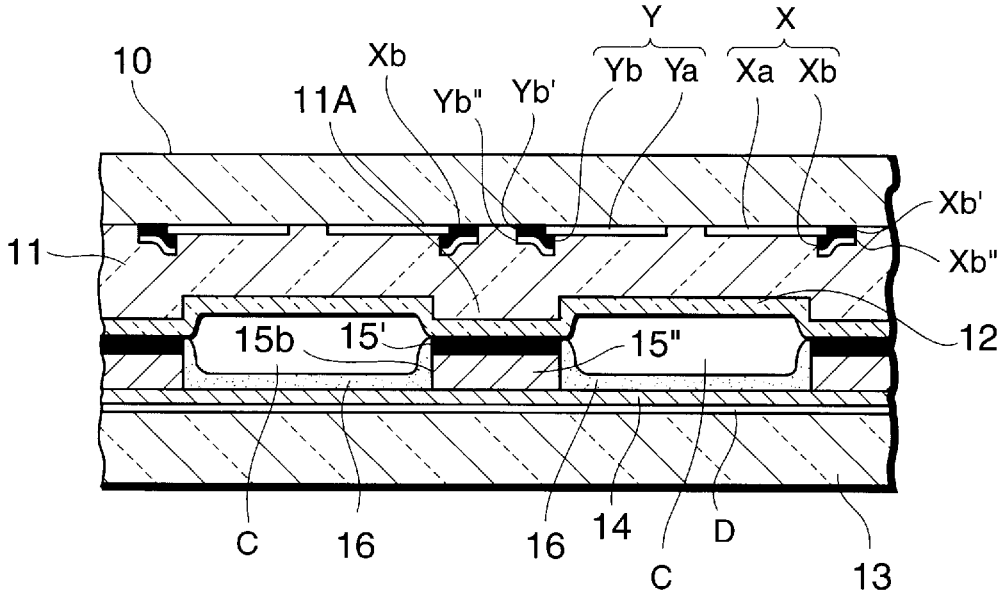
FIG.31 PRIOR ART
FIG. 31 is a sectional view taken along the V1—V1 line of FIG. 30.
Figure 32:
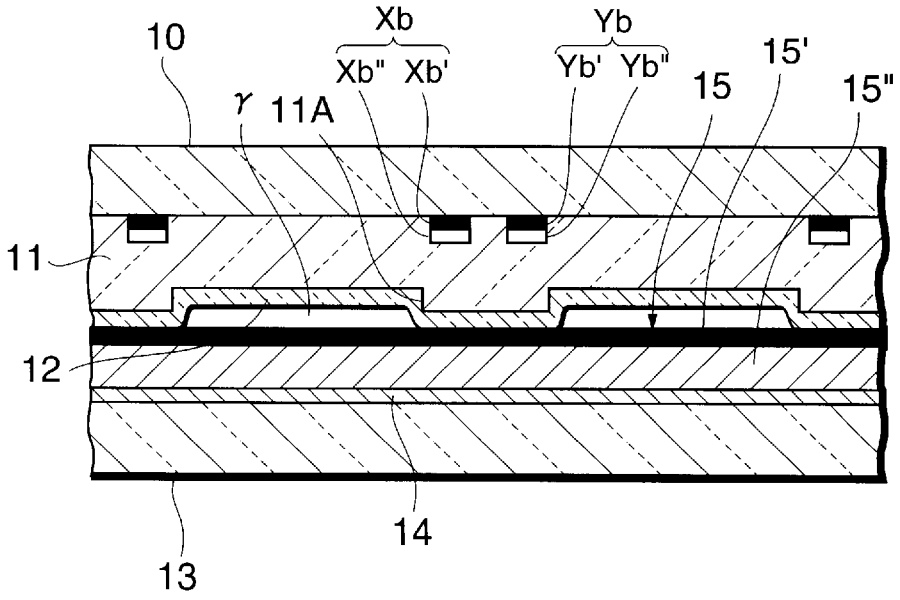
FIG.32 PRIOR ART
FIG. 32 is a sectional view taken along the V2—V2 line of FIG. 30.
Figure 33:
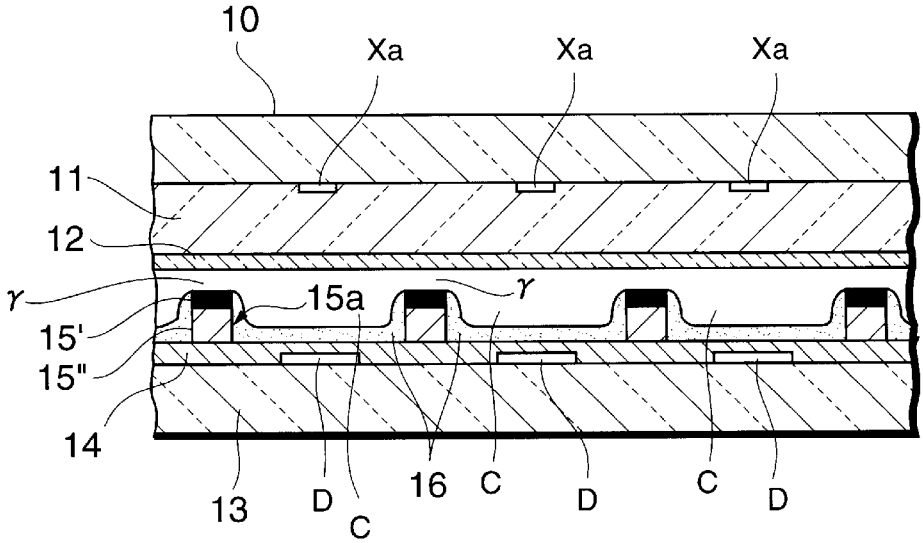
FIG.33 PRIOR ART
FIG. 33 is a sectional view taken along the W1—W1 line of FIG. 30.
Figure 34:
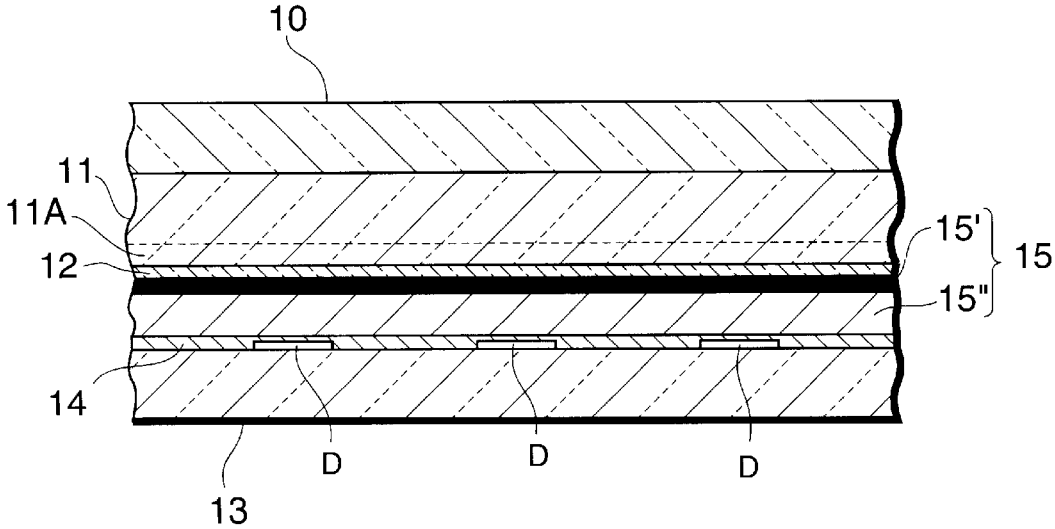
FIG.34 PRIOR ART
FIG. 34 is a sectional view taken along the W2—W2 line of FIG. 30.

Specifically, in FIG. 25, arrangement of row electrodes X2 and Y2 in each row electrode pair (X2, Y2) and configuration of a partition wall and other components are similar to the case in the seventh example. Configuration of transparent electrodes X2*a* and Y2*a* is similar to those of the conventional PDP illustrated in FIG. 30.

However, between the adjacent row electrode pairs (X2, Y2) protrusions Y2*b*' are formed on the opposite side faces of the bus electrodes Y2*b* in a staggered form along the row direction. The protrusion Y2*b*' protrudes from one bus electrode Y2*b* toward the other bus electrode Y2*b* to form a discharge gap g2 between the protrusion Y2*b*' and the other bus electrode Y2*b*. The priming discharge cell C1 is formed in a portion facing the discharge gap g2 in the clearance SL between transverse walls 25*b*.

As in the PDP of the seventh example, in the PDP of the eighth example, priming particles are also caused by the priming discharge caused between the protrusion Y2*b*' of the bus electrode Y2*b* and the other bus electrode Y2*b* opposing it in the address period Wc when the image is formed. The resulting priming particles diffuse into the adjacent discharge cells C in the column direction, resulting in exerting the priming effect for the sustaining discharge in the discharge sustaining period Ic.

The arrangement, shape and so on of the protrusion Y2*b*' of the bus electrode Y2*b* is not limited to the example of the drawings, and they can arbitrarily set, provided that the priming discharge is secured.

Figure 26:
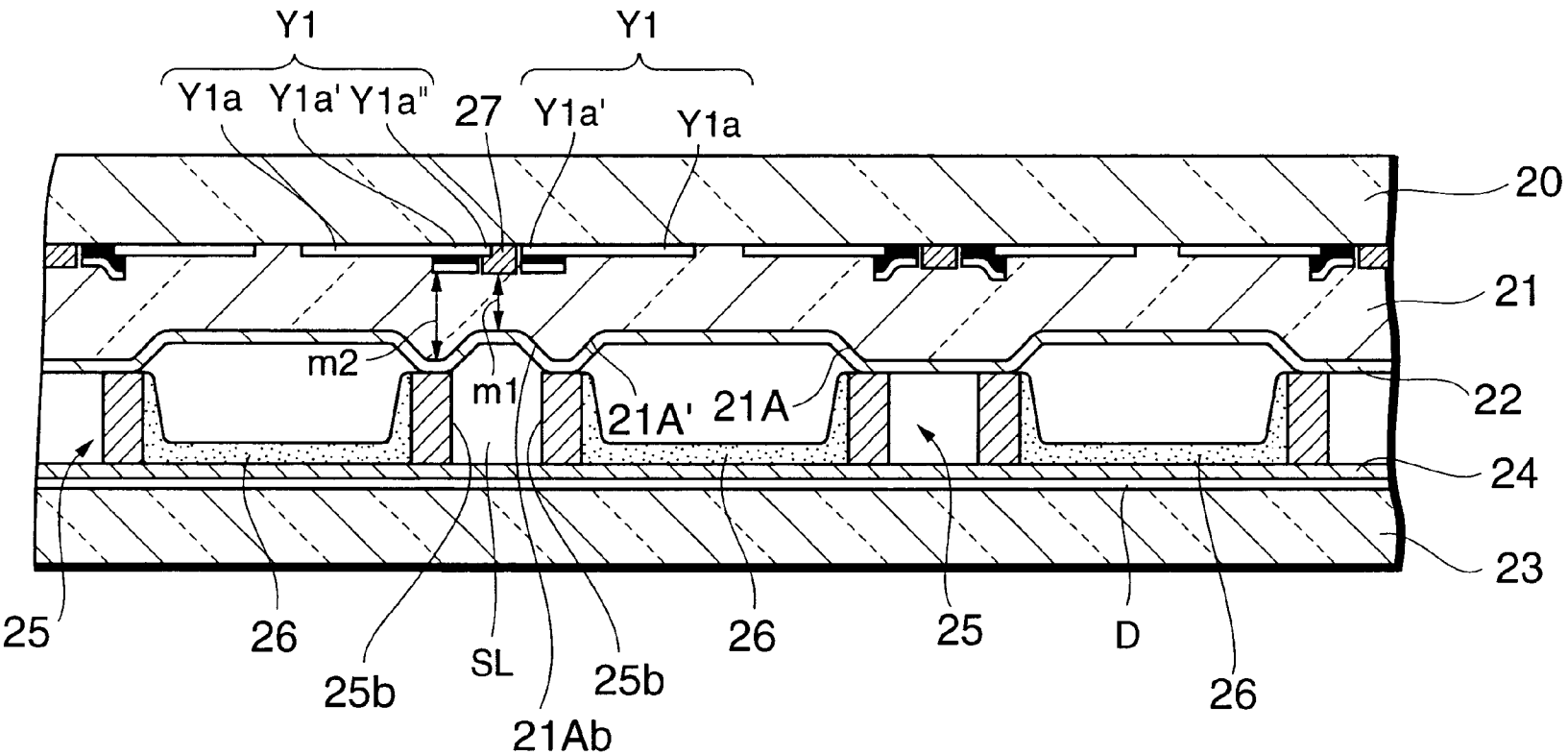
FIG. 26 is a sectional side view schematically showing a ninth example according to the present invention.
Figure 27:
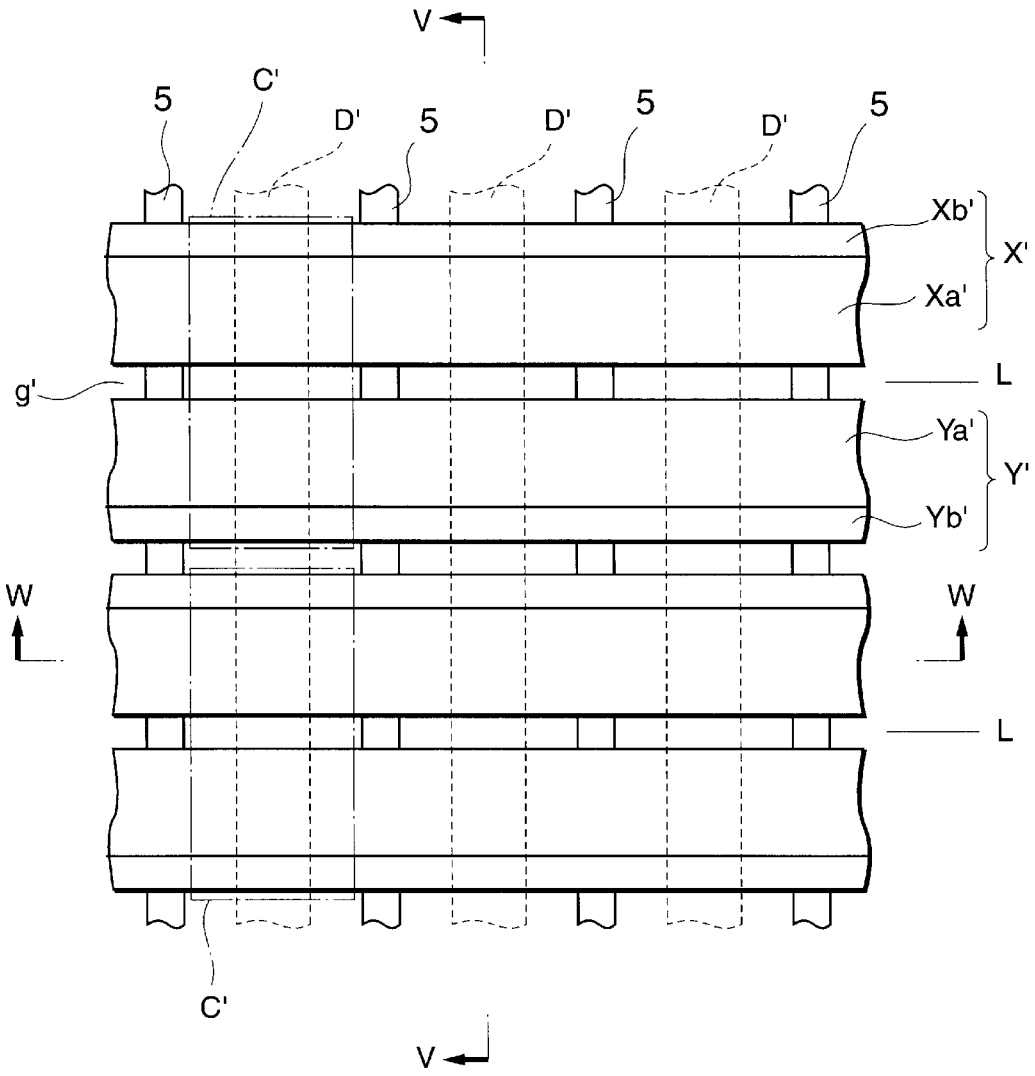
FIG.27 PRIOR ART
FIG. 27 is a front view schematically showing a configuration of a conventional PDP.
Figure 28:
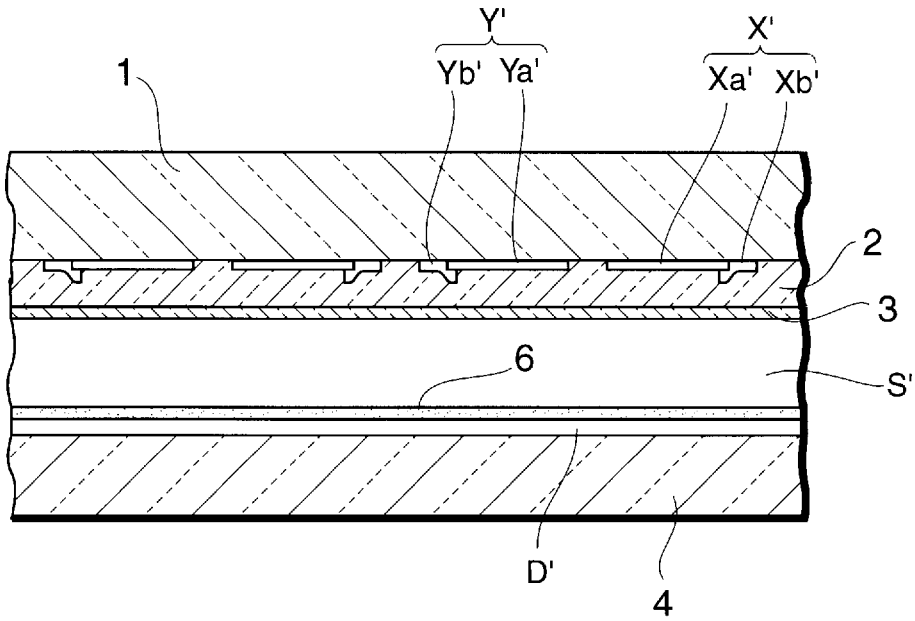
FIG.28 PRIOR ART
FIG. 28 is a sectional view taken along the V—V line of FIG. 27.
Figure 29:
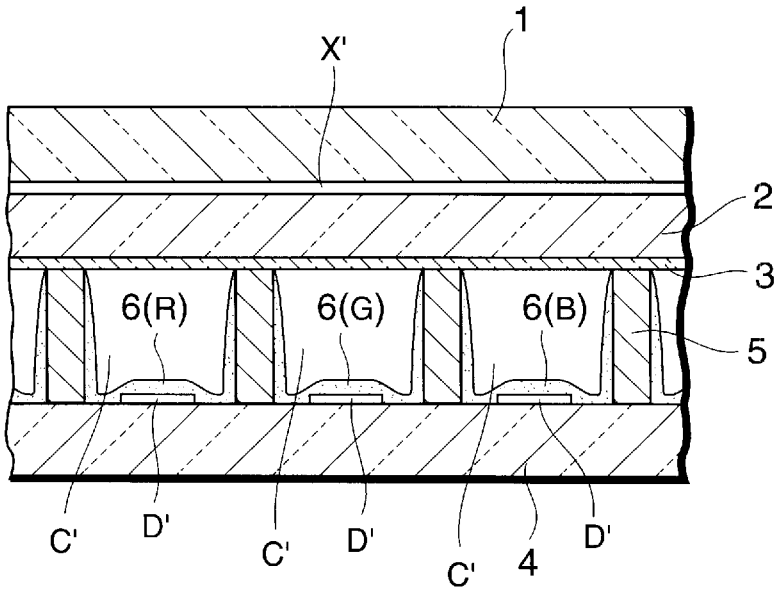
FIG.29 PRIOR ART
FIG. 29 is a sectional view taken along the W—W line of FIG. 27.

FIG. 26 is a front view schematically illustrating a ninth example of the embodiment according to the present invention.

In a PDP of the ninth example, in a portion of the additional dielectric layer 21A' formed opposing the two back-to-back row electrodes Y1, which is opposite to the discharge gap (g2) between the row electrodes Y1 in the PDP of the aforementioned seventh example, a recess portion 21A*b* is formed to recess toward a front glass substrate 20. A thickness m1 of the portion of the additional dielectric layer 21A' opposing the discharge gap (g2) is formed to be smaller than a thickness m2 of other portions thereof.

In this way, due to the smaller thickness of the portion of the additional dielectric layer 21A' opposing the discharge gap (g2) in which the priming discharge is caused, the occurrence of the priming discharge is facilitated, which guarantees the priming effect in the sustaining discharge with reliability.

The remaining configuration of the PDP in the ninth example is the same as that of the PDP in the seventh example.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a plurality of row electrode pairs extending in a row direction and arranged in a column direction to form display lines and a dielectric layer overlaying the row electrode pairs on a backside of a front substrate, and a plurality of column electrodes extending in the column direction and arranged in the row direction to constitute unit light emitting areas in the discharge space at respective positions, corresponding to intersections of the column electrodes and the row electrode pairs, on a face of a back substrate facing the front substrate with a discharge space in between, said plasma display panel comprising:

a partition wall arranged between said front substrate and said back substrate, and having vertical walls extending in the column direction and the transverse walls extending in the row direction to define said discharge space into each of the unit light emitting areas in the row direction and the column direction;

a clearance extending in parallel to the row direction, and separating the transverse wall situated between the adjacent unit light emitting areas respectively in the column direction; and a communicating section for making communication between the inside of said clearance and the inside of the discharge spaces in the adjacent unit light emitting areas in the column direction.

2. The plasma display panel according to claim 1, further comprising:

an additional portion formed on each part of the dielectric layer opposing said transverse wall of said partition wall and said clearance to protrude toward the transverse wall to shield the adjacent unit light emitting areas in the column direction in cooperation with said transverse wall, said communicating section is formed in the additional portion.

3. The plasma display panel according to claim 1, wherein said communicating section is formed in said transverse wall of said partition wall.

4. The plasma display panel according to claim 1, wherein at least a portion of said transverse wall of said partition wall is lower in height than that of said vertical wall to form a clearance between the transverse wall and the dielectric layer to constitute said communicating section.

5. The plasma display panel according to claim 1, further comprising a dielectric rib having a lower height than that of said partition wall and formed in part of said clearance opposing the column electrode on the back substrate.

6. The plasma display panel according to claim 5, wherein said column electrode is formed on said dielectric rib.

7. The plasma display panel according to claim 5, wherein said dielectric rib is formed in an island-like shape for each column electrode.

8. The plasma display panel according to claim 5, wherein said dielectric rib is formed in a band-like shape extending in the row direction.

9. The plasma display panel according to claim 1, further comprising a layer made of materials of a high coefficient of secondary electron emission, and formed in the part in said clearance opposing the column electrode on the back substrate.

10. The plasma display panel according to claim 1, further comprising a light absorption layer provided on the part of the front substrate opposing said clearance.

11. The plasma display panel according to claim 1, further comprising a phosphor layer emitting ultraviolet radiation and provided in at least a part of the parts of said front substrate, said back substrate, and said partition wall opposing said clearance formed in said transverse wall of the partition wall.

12. The plasma display panel according to claim 1, further comprising a discharge section provided in the opposite parts of the respective back-to-back row electrodes of said adjacent row electrode pairs for causing discharge in a space in said clearance, wherein the space in said clearance and the inside of the discharge spaces in the adjacent unit light emitting areas in column direction is communicated with each other through said communicating section.

13. The plasma display panel according to claim 12, wherein at least one side of opposite sides of the respective back-to-back row electrodes of the adjacent row electrode pairs protrudes toward the other side to form a discharge gap, having a required size and facing a space in said clearance, between the one side and the other side for formation of said discharge section.

14. The plasma display panel according to claim 13, wherein said row electrode comprises a transparent electrode causing discharge in each unit light emitting area and a bus electrode connected to the transparent electrode, wherein at least one transparent electrode of the transparent electrodes of the respective back-to-back row electrodes of the adjacent row electrode pairs is protruded toward the other transparent electrode to form said discharge gap.

15. The plasma display panel according to claim 13, wherein said row electrode comprises a transparent electrode causing discharge in each unit light emitting area and a bus electrode connected to the transparent electrode, wherein at least one bus electrode of the bus electrodes of the respective back-to-back row electrodes of the adjacent row electrode pairs is protruded toward the other bus electrode to form said discharge gap.

16. The plasma display panel according to claim 13, wherein said discharge gap is set to have a size smaller than that of a discharge gap between the row electrodes in each row electrode pair.

17. The plasma display panel according to claim 12, wherein a first row electrode and a second row electrode constituting said row electrode pair are alternately interchanged in the column direction, wherein said discharge section is formed between the opposite first row electrodes or the opposite second row electrode of the adjacent row electrode pairs.

18. The plasma display panel according to claim 12, further comprising priming discharge sections formed in the part of the row electrodes, oriented back to back and provided with said discharge section, in a non-display area of the plasma display panel for causing discharge in the space in said clearance.

19. The plasma display panel according to claim 12, further comprising:

an additional portion formed on each part of the dielectric layer opposing said transverse wall of said partition wall and said clearance to protrude from the dielectric layer toward the transverse wall to shield the adjacent unit light emitting areas in the column direction from each other in cooperation with said transverse wall, a thickness of part of said additional portion opposing said discharge section being smaller than that of other parts.

* * * * *